US005598931A

United States Patent [19]

Hosogoshi et al.

[11] Patent Number: 5,598,931

[45] Date of Patent: Feb. 4, 1997

[54] SIFTER FRAME FOR POWDER PARTICLE SIFTER

[75] Inventors: Yasunobu Hosogoshi; Toshio Maruo; Yasuo Sakata; Katsumasa Morita; Takefumi Ibori; Harumi Kubota, all of Tokyo; Toshio Douzono, Hyogo; Kanemitsu Nakagawa, Hyogo; Kunio Sugihara, Hyogo; Yukio Yoshizawa, Hyogo; Yoshiaki Aridome, Hyogo; Shoji Yamanaka, Saitama, all of Japan

[73] Assignee: Nisshin Flour Milling Co., Ltd., Tokyo, Japan

[21] Appl. No.: 335,578

[22] Filed: Nov. 7, 1994

[30] Foreign Application Priority Data

Oct. 11, 1994 [JP] Japan ..... 6-245505
Oct. 28, 1994 [JP] Japan ..... 6-265792

[51] Int. Cl.[6] ..... B07B 1/49

[52] U.S. Cl. ..... 209/405; 209/408; 209/412

[58] Field of Search ..... 209/323, 405, 209/408, 409, 411, 412

[56] References Cited

U.S. PATENT DOCUMENTS

| | | | |
|---|---|---|---|
| 2,181,605 | 11/1939 | Norvell | 209/408 |
| 2,455,383 | 12/1948 | Pickard | 209/323 |
| 2,576,794 | 11/1951 | Jost et al. | 209/412 X |
| 3,565,251 | 2/1971 | Pennington | 209/405 X |
| 5,193,689 | 3/1993 | Hoppe | 209/405 X |

FOREIGN PATENT DOCUMENTS

| | | | |
|---|---|---|---|
| 892887 | 6/1944 | Germany . | |
| 2506981 | 6/1976 | Germany . | |
| 705389 | 3/1954 | United Kingdom . | |
| 720437 | 12/1954 | United Kingdom | 209/323 |
| 883054 | 11/1961 | United Kingdom . | |

*Primary Examiner*—William E. Terrell
*Assistant Examiner*—Tuan Nguyen
*Attorney, Agent, or Firm*— McAulay Fisher Nissen Goldberg & Kiel, LLP

[57] ABSTRACT

A sifter frame is composed of a pair of frame elements including an outer frame and an inner frame, and the outer frame is formed from a frame member having the same height and includes a pair of fine powder dropping ports, a rough powder dropping port and a rectangular fine powder receiving plate disposed in a region surrounded by these openings and one of the outer block frame members and the inner frame is fitted with the space above the receiving plate. A pair of the outer frame members of the inner frame in contact with the fine powder dropping ports of the inner frame are projected more to the rough powder dropping port than the outer block frame members of the inner frame in contact with the rough powder dropping port of the outer frame, receiving portions are provided with the outer frame in correspondence with the above arrangement so that the projected portions of the inner frame are placed thereon as well as the surfaces where the projected portions are engaged with the receiving portions are formed to an arc shape in order to that a depressing force of an upper stage sifter frame is applied to the engaging surfaces where the inner frame of a lower stage sifter frame is engaged with the outer frame thereof as a sealing force. With the above arrangement, there is provided a novel stacking type sifter frame by which the mixture of rough powder with fine powder can be securely prevented while limiting a portion to be periodicially replaced to a minimum necessary portion.

4 Claims, 27 Drawing Sheets

SIFTER FRAME FOR POWDER PARTICLE SIFTER

BACKGROUND OF THE INVENTION

1. Field of the Invention

The present invention relates to a sifter frame used for a sifter for separating the particle sizes of powder particles such as flour and the like, and more specifically, to structure of an intimate contact type sifter frame used by being stacked in multi-stages to sift and separate powder particles.

2. Description of the Related Art

Sifters are conventionally used to separate the particle sizes of powder particles such as flour and the like. The sifter will be described below with respect to the separation of the particle sizes of flour by way of example.

Sifters are known in different types such as a plan sifter, square sifter and the like which have been used in the flour milling industry for a long time to separate the particle sizes of flour. At present, various types of sifters such as the modifications of the above sifters and intermediate type sifters (such as a junior type sifter and the like) are put into practical use. These sifters are fundamentally arranged such that powder having a small particle size is supplied onto the sifter and is caused to pass through the sifter downwardly while a multiplicity of stacked sifter frames are caused to make a circular motion to separate the particle sizes of the supplied powder. A reason why the flour sifter is composed of the sifter frames stacked in multi-stages as described above is to make a sifter area as large as possible, which is desirable to effectively separate flour by moving the flour on the surface of the sifter. To achieve this object, an area of the sifter per unit area of installation is increased to save an installation area so that the sifter is composed of sifter frames stacked in multi-stages and a sifter surface on which flour moves is formed so that the sifter surface vertically meanders in the sifter.

The sifter is usually composed of a group of stacked square sifter frames tightened from the upper and lower sides thereof or a group of sifter frames which are stacked to ten to twenty stages and accommodated in a sifter frame box called a box so that they are horizontally tightened and fixed and also tightened and fixed from the upper side thereof. Then, the box and the like are driven by a drive unit composed of an eccentric shaft provided with a balance weight and a drive shaft to make a circular motion within a horizontal plane at high speed.

Since sifter nets used for the sifter frames constituting the sifter are required to be checked and replaced at predetermined intervals, several hundreds to several thousands of the sifter nets must be always stored to cope with the requirement in industrial equipment. To facilitate replacement, conventionally employed is a sifter frame which has a structure for limiting a portion to be replaced only to a sifter net. That is, there are generally used a pair having a frame member of about 1 m×1 m (referred to as an outer frame) and a frame member having a sifter net stretched therein as an object to e replaced (referred to as an inner frame) with the inner frame being engaged with the outer frame. With the employment of this arrangement, even if several thousands of the sifter frames are required to be prepared and stored, since the outer frames can be repeatedly used, it suffices only to actually prepare the inner frames, which is preferable from the view point of industrial facility because the volume and weight of the inner frames to be stored are reduced and a replacing job can be simplified and labor can be saved accordingly.

A structure of the conventionally used sifter frame will further be described in more detail with reference to FIG. 32–FIG. 36.

The conventional type sifter frame shown in these figures has a combination type structure arranged such that a rectangular inner frame 500 (refer to FIG. 32) is fitted with the inner frame fitting portion of an outer frame 600 (refer to FIG. 33), the inner frame 500 having a sifter net 501 stretched over the upper surface thereof to separate flour to powder on a sifter (rough powder) and powder below the sifter (through: fine powder), and the outer frame 600 being in contact with the three circumferential sides of the inner frame and having a longitudinal path in an upward/downward direction (refer to FIG. 34).

The above inner frame 500 shown in FIG. 32 is composed of wood frame member 502–505 of, for example, wood for constituting a rectangular four-sided frame and a sifter net 501 having a predetermined shifting mesh and stretched over reinforcing wood bars 506, 507 formed to a cross shape and disposed inwardly of the rectangular frame member. Note, although not shown, a crimp net having a rough mesh is usually stretched below the sifter net 501 in parallel therewith and a cleaner such as, for example, a triangular flat cleaner having a hemispheric projection is movably interposed between the upper and lower nets so that clogging the sifter net 501 is prevented by causing the cleaner to beat the net when the sifter is in operation.

The outer frame 600 shown in FIG. 33 is composed of an inner frame fitting portion with which the above inner frame 500 is fitted in contact with (biased to) an outer side wall (outer block member) 610 as one of the four sides of the rectangular frame forming the outer block of the outer frame 600 and longitudinal paths 601, 602, 602 disposed outwardly of the inner frame fitting portion in an upward/downward direction along the inside of each of the remaining three sides except the side wall 610 of the above one side. Specifically, the outer frame 600 is composed of a pair of parallel inner side walls (frame members) 607, 607 disposed to form the above inner frame fitting portion, three inner frame fitting stand frames 604, 605, 606 fixed over the lower surfaces of the inner side walls 607, 607, a pair of outer side walls 608, 608 disposed separately to form the fine powder dropping ports 602, 602 to the outside of each of the above outer inside walls 607, 607, the outer side wall 610 disposed in contact with the outside of the inner frame fitting stand frame 606, an outer side wall 609 separately disposed to form a rough powder dropping port 601 (usually, called an over port) outwardly of the inner frame fitting stand frame 604, and a receiving plate (fine powder flowing plate) 603 provided as a bottom surface for introducing fine powder (through) having passed through the sifter net 501 of the inner frame to be fitted to the above right and left dropping ports 602, 602. Note, the inner side walls 607, 607 are fixed to the outer side walls 608, 608 at suitable positions through intermediate brackets 613, 613, and the inner frame fitting stand frame 604 is fixed to the outer side wall 609 through an intermediate bracket 615 in the same way. Numeral 614 denotes blocks disposed at four corners to close the unnecessary space portions in the outer frame as well as to increase the strength of a fitting structure in an upward/downward direction.

The receiving plate 603 is composed of a stainless steel sheet or the like fixed to the respective lower surfaces of the above inner frame fitting stand frames 604, 605, 606 by screws. With this arrangement, each of the right and left ends of the receiving plate 603 has a gap corresponding to the thickness of the stand frames 604, 605 between the lower surface of the inner side wall 607 and the receiving plate 603, and these gaps form slit-shaped fine powder dropping ports 617 for dropping fine powder onto the receiving plate 603 into the right and left fine powder dropping ports 602. Note, the receiving plate 603 is disposed substantially at the intermediate position in the upward-downward direction of the sifter frame in a bottom-lifted-state (refer to FIG. 35). With this arrangement, a space in which powder moves on the sifter net 501 of a lower stage sifter frame is provided with sifter frames are stacked. Note, when a direction is described below, a direction in which a pair of the fine powder dropping ports 602 is separated from each other is referred to as a right/left direction and a direction orthogonal to the right/left direction in a horizontal direction is referred to as a forward/backward direction.

A group of the sifter frames having the above arrangement can be constructed by stacking a multiplicity of the sifter frames in such a manner that the positions of the rough powder dropping ports 601 are successively reversed (alternately disposed) on the respective stages (refer to FIG. 35). Then, powder particles having moved (flown) on the sifter net 501 of a certain stage drop into the rough powder dropping port 601 of the inner frame 5 along the inclined surface 502*a* of the frame member 502 in contact with the rough powder dropping port 601 and move onto the sifter net of the sifter frame of the next lower stage. Further, fine powder having passed through the sifter net 501 drops onto the receiving plate 603 and further drops into the fine powder dropping ports 602 through the right and left slit-shaped fine powder dropping port 617.

Note, press beams 620, 620 are disposed between the outer side walls 609, 610 below the receiving plate 603 of the outer frame 600 so that the press beams 620, 620 extend to the upper surfaces of the inner side wall 607 and the frame member 504 (or 505) of the inner frame of the lower stage sifter frame to cover them in contact therewith (refer to FIG. 35).

Incidentally, the sifter is naturally required to securely prevent the mixture of rough powder with fine powder caused through the gap defined at the inner frame fitting position. For this purpose, the lower portion of the frame member 502 of the inner frame 500 is provided with a stepped portion as shown in FIG. 34(*b*) and the stepped leg portion 502*b* is engaged with the stepped portion 604*a* of the inner frame fitting stand frame 604 formed in correspondence with the outer frame to form seal portions.

FIG. 34(*a*) is an unfolded view for explaining a relationship between the outer frame 600 and the inner frame 500 fitted therewith, and FIG. 35 is an unfolded view for explaining a state that the sifter frames each arranged as described above are stacked with the rough powder dropping ports 601 thereof successively disposed alternately. Note, in FIG. 35, surfaces 700, 701 shown phantom lines serve as sealed surfaces for strongly pressing the inner frame 500 of lower stage the sifter frame downwardly by the upper stage sifter frame (outer frame 600) so as to increase the seal pressure of the above seal portions and at the same time to seal and partition a region (rough powder region) where rough powder flows from a region where fine powder flows (fine powder region). A suitable seal sheet is applied to the surfaces 700, 701 as necessary.

In the aforesaid conventional sifter, although a group of the sifter frames is composed of a multiplicity of the stacker sifter frames each arranged as described above to sift and separate flour, it is known that actually a slight amount of rough powder is mixed with fine powder.

Since the mixture of rough powder and the like caused by the conventional sifter is not ignored in a strict meaning regardless of a recent tendency that a powder product which has an increased added value or with which any rough powder and the like is not mixed at all is required, however, the sifter is desired to be further improved.

The inventors have discovered the following by examining a cause of the mixture of rough powder with fine powder, taking the present state mentioned above into consideration. That is, there is a problem that although the mixture of rough powder with fine powder in the conventional sifter frame is not caused on the above seal surfaces 700, 701 which are in intimate contact with each other under pressure, the mixture of them is caused at the portion where the frame member 502 is fitted with the inner frame fitting stand frame 604.

This will be described as follows with reference to FIG. 36. More specifically, first, although the portion where the frame member 502 of the inner frame in contact with the rough powder dropping port 601 is fitted with the inner frame fitting stand frame 604 of the outer frame is sealed by the engagement of the stepped portion 502*b* with the stepped portion 604*a* shown in FIG. 34(*b*), no pressure is directly applied to the portion from the upper and lower frames to make intimate contact therebetween. Thus, a problem arises in that they are not sufficiently sealed. Further, the following becomes apparent as a larger problem. That is, although brackets 616 provided to form the inner frame fitting portion of the outer frame is engaged with the extreme (front) end surfaces (surfaces facing to the rough powder dropping port) 504*a*, 505*a* of the right and left frame members 504, 505 of the inner frame to seal a fine powder region and a rough powder region, no pressure is applied to make intimate contact of the both surfaces of the fitting portion in the structure. More specifically, the direction of a horizontal force for causing both surfaces to come into intimate contact with each other is different 90° away; from a vertical force for causing the upper and lower sifter frames to come into intimate contact with each other. On the other hand, a gap is inevitably produced between the surfaces due to a dimensional allowance in production and a dimensional variation caused by the elapse of time as an actual problem. Consequently, it is difficult to completely prevent the phenomenon that rough powder flowing on the sifter net as shown by a thick solid line 800 in FIG. 36 moves at random in the sifter frame which is violently vibrated when the powder is separated by the sifter and enters a gap between the above extreme end surface 505*a* and the bracket 616 as shown by a thick dotted line 801 in the figure. Further, since it is also inevitable that a gap is produced between the outside surface of the frame member 505 (504) of the inner frame and the inside surface of the inner side wall 607 of the outer frame, the rough powder having entered the above gap further moves and enters the fine powder region as shown by dotted lines 802, 803, by which the aforesaid mixture is caused.

Further, since the frame member 502 in contact with the rough powder dropping port of the inner frame is not directly pressed in an upward/downward direction by the outer frame of the upper/stage sifter frame being stacked, a force for causing the both surfaces of the frame member 502 and the above member (inner frame fitting stand frame 604) to come into intimate contact with each other is weakened in the vicinity thereof. As a result, since it is inevitable that a gap is produced between the frame member 502 and the stand frame 604 by the vibration of the sifter frame, rough powder also enters the fine powder region at this portion.

The problem that rough powder enters the fine powder region though the gaps between the confronting surfaces to which the above intimate contact force is not applied can be of course solved by providing a sifter frame of an inner frame and an outer frame which are integrally arranged each other so that the sifter frame is not divided into the inner frame and the outer frame. With this arrangement, however, the aforesaid requirement cannot be satisfied from the view point of the industrial equipment for limiting the portion to be replaced of each fo the sifter frames, which can amount to several thousands to an area as small as possible in order to that storing volume is reduced and labor for a replacement job is saved.

Further, there is a possibility that the influence resulting from vibration can be prevented so as to avoid the aforesaid unacceptable matters by the employment of a method of fixing the inner frame to the outer frame by means of tightening means such as bolts or the like, When such a method is employed, the attachment and detachment of the inner frame to and from the outer frame is very time consuming, by which the device of partially replacing the sifter frame is made quite useless.

An object of the present invention is to provide a novel powder separating sifter frame by solving the above various problems which is capable of reducing a storing volume by limiting a portion of a sifter frame to be prepared and stored as well as satisfying a requirement for saving labor needed for a replacement job and securely preventing the mixture of rough powder with fine powder which has been sometimes caused by a conventional sifter frame.

SUMMARY OF THE INVENTION

A sifter frame of the present invention made to achieve the above object is arranged as described below.

That is, a first feature of the present invention resides in the arrangement that a sifter frame for a powder particle sifter composed of a pair of frame elements including an inner frame and an outer frame, the inner frame being formed to a rectangular four-sided shape by outer block frame members each having the same height and having a sifter net stretched over the upper surface of the inner region surrounded by the outer block frame members;

the outer frame being formed to a rectangular four-sided shape by outer block frame members each having the same height and including each of fine powder dropping ports opened in an upward/downward direction along both inner sides of a pair of the confronting sides of the outer block frame members, a rough powder dropping port opened in an upward/downward direction along the inside of one of the other pair of the confronting sides, and a rectangular fine powder receiving plate horizontally disposed at a position of intermediate height in the region surrounded by the three ports and the other of the other pair of the confronting sides wherein the space on the receiving plate enables fine powder on the receiving plate to be dropped into the fine powder dropping ports but being partitioned from the rough powder dropping port by a partition wall; and the inner frame being disposed to be fitted with the space on the receiving plate of the inner frame, wherein:

a closed annular downward seal surface is formed to the frame members of the inner frame which are in contact with the fitting portion of the outer frame on the same horizontal surface as well as a closed annular upward seal surface is formed to the frame members of the fitting portion of the outer frame which are in contact with the inner frame in confrontation with the closed annular downward seal surface of the inner frame to press the downward seal surface under pressure.

In the above arrangement, it is preferable that the seal surfaces of the inner frame and the outer frame are kept to a good seal state by being applied with an intimate contact seal sheet. A sheet suitable for the intimate seal includes non-woven fabric, felt, an elastic seal packing material and the like.

Further, the above seal surface is formed such that, for example, an upper flange having the same height and projecting outward is annularly and continuously formed to the outer side wall (outside circumference) of the outer block frame members of the inner frame and a downward seal surface is formed on the lower surface of the upper flange. Further, the outer frame is provided with a stepped portion to be engaged with the stepped portion of the inner frame and the above upward seal surface is formed to the surface of the stepped portion confronting the lower surface of the upper flange.

A second feature of the present invention resides in the arrangement that a sifter frame for a powder particle sifter composed of a pair of frame elements including an outer frame and an inner frame, the outer frame having an outer block formed to a rectangular four-sided shape by outer block frame members each having the same height and including in the inside of the outer block each of a pair of fine powder dropping ports opened in an upward/downward direction along both inner sides of a pair of the confronting sides of the rectangular four sides, a rough powder dropping port opened in an upward/downward direction along the inside of one of the other pair of the confronting sides, outer block frame members constituting the sides opposite to the other pair of the confronting sides, and a rectangular fine powder receiving plate horizontally disposed at a position of intermediate height in the region surrounded by the rough powder dropping port and the fine powder dropping ports wherein the space on the receiving plate enables fine powder on the receiving plate to be dropped into the fine powder dropping ports but being partitioned from the rough powder dropping port by a partition wall; and the inner frame being formed in a substantially rectangular four-sided shape by outer block frame members each having the same height and fitted with the space on the receiving plate of the outer frame without producing any gap therebetween so that the upper surface of the inner frame is flush with the outer frame wherein fine powder is sifted from the rough powder in powder particles moving on a rectangular sifter net stretched over the ceiling surface of the outer block frame members through the sifter net and dropped onto the receiving plate, wherein:

the inner frame is provided with a pair of the outer block frame members in contact with the fine powder dropping ports of the outer frame, the outer block frame member projecting more to the rough powder dropping port than the outer block frame members of the inner frame in contact with the rough powder dropping port of the outer frame, as well as the outer frame is provided with a receiving portion on which the projected portions of a pair of the outer block frame members of the inner frame are to be placed and arc-shaped or inclined seal surfaces are formed to the surfaces where the projected portions are engaged with the receiving portion.

In the above arrangement, it is preferable that an intimate contact (air tight) seal sheet is applied to any of the arc-shaped or inclined engaging surfaces where the projected portions of the outer block frame members of the inner frame are engaged with the receiving portion formed to the outer frame on which the projected portions are to be placed. The aforesaid sheets are also suitable for the intimate contact seal.

Further, in the above arrangement, it is particularly preferable that the side surface of the inner frame where the outer block frame members in contact with the rough powder dropping port faces to the rough powder dropping port is formed to be flush with the side surface of the outer frame where the partition wall partitioning the space on the receiving plate of the outer frame from the rough powder dropping port faces to the rough powder dropping port, as well as a shield sheet member for covering up to the side surface of the outer frame is formed to the side surface of the inner frame.

With this arrangement, there can be securely prevented a possibility that powder enters the fine powder region where only sifted fine powder exists from the vicinity of the rough powder dropping port.

Note, the sifter frames of this example are used by being stacked in multi-stages, and it is needless to say that a seal member is provided to the lower surface of the sifter frame of the upper stage in the same way as prior art, the seal member extending to and air-tightly engaging with the upper surfaces of the frame members of both sides which are in contact with the engaging surfaces (engaging surfaces confronting in a horizontal direction) of the sifter frame of the lower stage formed by the inner frame fitted with the outer frame. For example, a seal member is provided to the lower surface of the sifter frame of the upper stage and extends to and engages with the upper surfaces of the outer block frame members of the inner frame and the reinforcing members of the outer frame so that powder does not pass onto the sifter net of the inner frame from a gap between the engaging surfaces where the outer block frame members of the inner frame in contact with the fine powder dropping ports are engaged with the reinforcing members of the outer frame in contact with the outer sides of the outer block frame members of the inner frame. It is preferable to apply a sheet suitable for intimate contact seal to the lower surface of the seal member (or to the surface engaging with the seal member). In this case, non-woven fabric, felt, an elastic seal packing material and the like are used similarly to the above. However, the reinforcing members of the outer frame may be omitted when there is no problem with respect to the strength of structure.

A third feature of the present invention resides in the arrangement that a sifter frame for a powder particle sifter composed of a pair of frame elements including an outer frame and an inner frame, the outer frame being formed to have an outer block of a rectangular four-sided shape by the combination of outer block frame members each having the same height and a receiving plate to include in the inside of the outer block each of a pair of fine powder dropping ports opened in an upward/downward direction along the inside of each of a pair of the confronting sides of the rectangular four sides, a rough powder dropping port opened in an upward/downward direction along the inside of one of the other pair of the confronting sides, outer block frame members constituting sides opposite to the other pair of the confronting sides, a rectangular fine powder receiving plate horizontally disposed at a position of intermediate height in the region surrounded by the rough powder dropping port and the fine powder dropping ports, and an inner frame fitting portion above the receiving plate and the rough powder dropping port; and the inner frame formed to a rectangular shape to be fitted with the inner frame fitting portion formed to the outer frame without producing substantially any gap therebetween and including each of a rectangular sifter net portion having a sifter net stretched over the ceiling surface of the inner frame to sift fine powder from rough powder and drop the sifted fine powder onto the receiving plate and a rough powder dropping port formed to a shape in coincidence with that of the rough powder dropping port of the outer frame along a side of the sifter net portion, wherein:

when a plurality of sifter frames each assembled by fitting the inner frame with the inner frame fitting portion of the outer frame are stacked to multi-stages so that the positions of the rough powder dropping ports are alternately disposed, a closed annular seal surface formed to the outer frame is air-tightly engaged with the closed annular seal surface formed by the inner frame and the outer frame of the sifter frame stacked to the lower stage to thereby seal the rough powder region and the fine powder region of each sifter net.

In the above arrangement, it is most preferable to form the lower surface of the sifter frame stacked to the upper stage in such a manner that the lower surface extends to and air-tightly engages with both upper surfaces of the outer frame and the inner frame which are formed by being fitted with the sifter frame stacked to the lower stage.

Further, in the above arrangement, it is preferable in a manner similar to the above to apply a sheet suitable for intimate contact seal along any one of the lower closed annular edge of the inner frame fitting portion of the outer frame or the lower closed annular edge of the outer frame fitting portion of the inner frame.

A fourth feature of the present invention resides in the arrangement that a sifter frame for a powder particle shifter composed of a pair of a lower frame and an upper frame, the lower frame being formed to have an outer block of a rectangular four-sided shape by the combination of outer block frame members each having the same height and a receiving plate to include in the inside of the outer block each of a pair of fine powder dropping ports opened in an upward/downward direction along the inside of each of a pair of the confronting sides of the rectangular four sides, a rough powder dropping port opened in an upward/downward direction along the inside of one of the other pair of the confronting sides, outer block frame members constituting sides opposite to the other pair of the confronting sides, a rectangular fine powder receiving plate horizontally disposed at a position of intermediate height in the region surrounded by the rough powder dropping port and the fine powder dropping ports, and an inner frame fitting portion above the receiving plate and the rough powder dropping port; and the upper frame including each of a rectangular sifter net portion having a sifter net stretched over the ceiling surface of a region confronting the upper portion of the receiving plate of the lower frame to sift fine powder from rough powder, a pair of fine powder dropping ports and a rough powder dropping port disposed so that the positions and the shapes thereof coincide with those of a pair of the fine powder dropping ports and the rough powder dropping port of the lower frame, with the outside shape of the upper frame being formed to coincide with that of the lower frame by the combination of frame members and the sifter net, wherein:

when a plurality of sifter frames each assembled by combining the lower frame and the upper frame are stacked to multi-stages so that the positions of the rough powder dropping ports are alternately disposed, a closed annular seal surface formed to the lower surface of the lower frame is air-tightly engaged with the upper surface of the sifter frame stacked to the lower stage to thereby seal the rough powder region and the fine powder region of each sifter frame.

In the above arrangement, it is preferable to provide positioning means such as, for example, a plurality of projectedly/recessedly formed fitting portions to be fitted with each other, or the like on the surfaces where the upper frame is vertically engaged with the lower frame to prevent horizontal dislocation.

Further, it is preferable in a manner similar to the above to apply a sheet suitable to secure air tight seal to any one of the seal surfaces where the sifter frame of the upper stage or the lower stage is engaged.

According to the sifter frame having the arrangement of the first feature of the present invention, since the inner frame having the limited arrangement as a sifter net portion is caused to come into intimate contact with the outer frame under pressure through the close curved type seal surface located on the same horizontal surface, the rough powder region can be partitioned from the fine powder region to such a strict degree which does not require to take a leakage portion into consideration. Thus, the mixture of fine powder with rough powder can be securely prevented.

According to the sifter frame having the arrangement of the second feature of the present invention, since a portion to be replaced is limited to the small inner frame having the sifter net portion, the weight and size of the inner frame can be reduced as compared with those of an inner frame arranged integrally as a whole. In particular, since the seal surfaces for partitioning and sealing the rough powder region from the fine powder region are formed as the closed type rectangularly annular edges located on the same horizontal surface and further an upward/downward intimate contact force acts on the arc-shaped or inclined engaging seal surfaces in the seal surfaces of the inner frame and the outer frame in the vicinity of the rough powder dropping port, the rough powder region can be strictly partitioned and sealed from the fine powder region.

According to the sifter frame having the arrangement of the third feature of the present invention, since a portion to be replaced is limited to the inner frame having the sifter net portion and the portion of the rough powder dropping port similarly to the above, the weight and size of the inner frame can be reduced as compared with those of an inner frame arranged integrally as a whole. Further, since the seal surfaces for partitioning and sealing the rough powder region from the fine powder region are formed as the closed type rectangularly annular edges located on the same plane and an upward/downward intimate contact force acts on the seal surfaces, a strictly partitioned seal can be achieved which need not take the leakage between the rough powder region and the fine powder region into consideration.

According to the sifter frame having the arrangement of the fourth feature of the present invention, since a portion to be replaced is limited to the upper frame, the weight and size of the upper frame can be reduced as compared with those of an upper frame arranged integrally as a whole. Further, the frame members of the upper frame may be formed to a shape which is substantially in coincidence with the shape of the frame members of the lower frame so that the engaging surfaces in an upward/downward direction of the frame members necessary to partition and seal the rough powder region from the fine powder region can be easily prepared, the partitioned seal can be kept in a good state.

Further, when the arrangement of the third and fourth features is employed, since the partitioning structure for partitioning the rough powder region from the fine powder region can be arranged by the frame members of the inner frame or the outer frame itself and these regions can be sealed only by the intimate contact of the horizontal seal surfaces which are engaged in an upward/downward direction, the above partitioning structure does not have the seal structure of prior art which contains a vertically sealed surface as shown in FIG. 32–FIG. 36. Consequently, there can be obtained a good partitioned seal by which a possibility that rough powder is mixed with fine powder is securely prevented.

Further, a better seal state can be secured by the application of an intimate contact sheet to each seal surface.

DETAILED DESCRIPTION OF PREFERRED EMBODIMENTS

Figure 1:
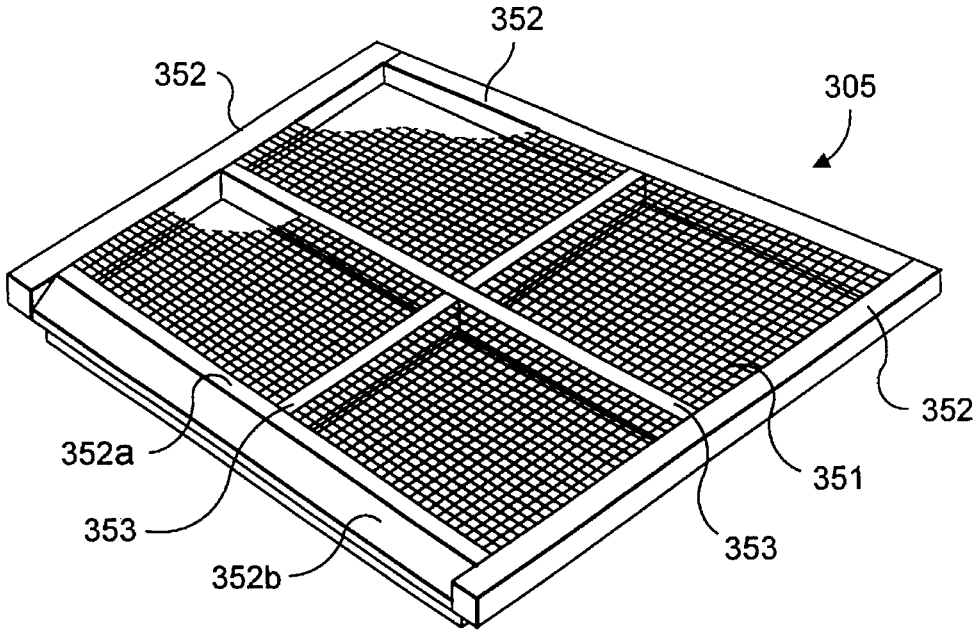
FIG. 1 is an outside perspective view of an inner frame constituting a sifter frame of an embodiment 1 of the present invention.

The present invention will be further explained with reference to embodiments shown in the drawings.

Embodiment 1

Figure 2:
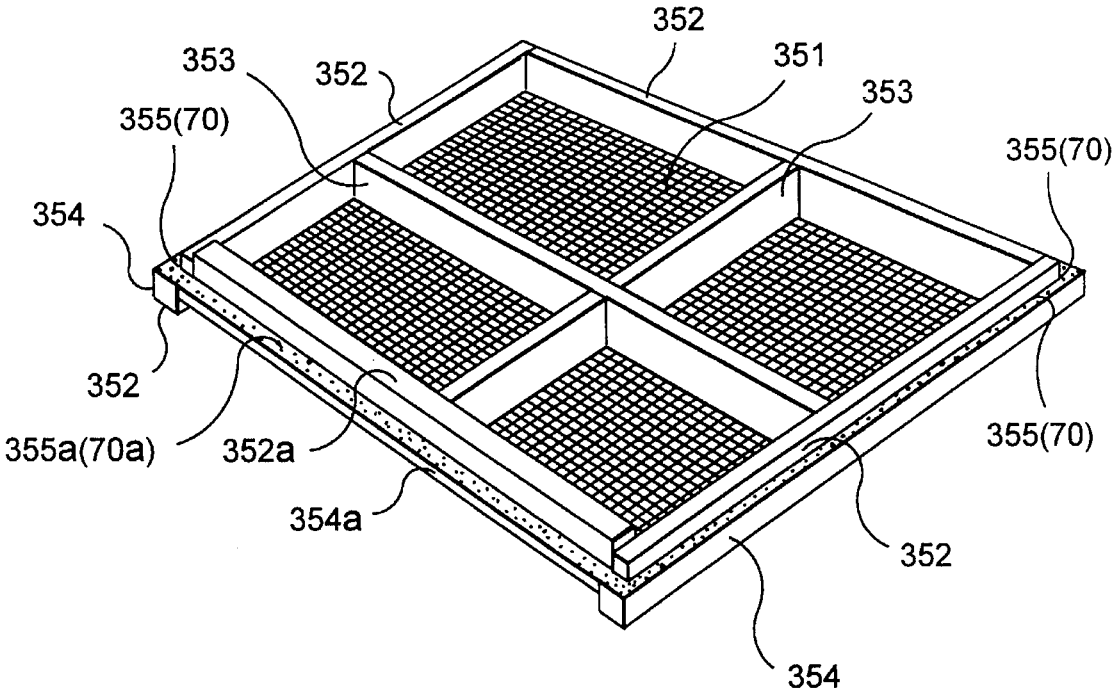
FIG. 2 is an outside perspective view observing the inner frame from a lower side.

FIG. 1 and FIG. 2 show a structure of an inner frame 305 of the embodiment 305 having a sifter net 351 stretched therein. The inner frame 305 is composed of a rectangular four-sided frame formed by outer block frame members 352, 352*a* and the sifter net 351 is stretched over the frame and reinforcing wood bars 353 formed to a cross shape in the rectangular frame. Note, a crimp net is stretched in parallel with the sifter net 351 and a cleaner is movably interposed therebetween (both not shown) to prevent the clogging of the net in the same way as in the prior art.

As is apparent from FIG. 2 showing the lower surface of the inner frame 305 of the embodiment which is observed by upsetting the inner frame 305, the inner frame 305 of the embodiment has the following features. That is, the frame members 352, 352*a* have upper flanges 354, 354*a* which project outwardly of the circumference thereof and are annularly continued over the rectangular four sides as a whole on the upper portions (lower portions in FIG. 2 showing the upset view thereof) of the frame members 352, 352*a* at the same height, the downward surfaces of the upper flanges 354, 354*a* (upward surfaces in FIG. 2 showing the upset view thereof) have intimate contact sheets 355, 355*a* applied thereto to form downward seal surfaces 370, 370*a*, and the frame member 352*a* at a position where rough powder on a sifter is dropped into a rough powder dropping port 361 of an outer frame to be described below has a cross sectional area larger than those of the other frame members. A reason why the frame member 352*a* has such a larger cross sectional area is to securely provide seal on the seal surface 370*a* by increasing the bending rigidity of the frame member 352*a* by increasing the modulus of section thereof. For this purpose, in this embodiment, the frame member 352*a* excluding the upper flange 354*a* has a width which is set larger than that of the other frame members 352 and has a height for enabling the lower end of the frame member 352*a* to come into contact with the receiving plate of the outer frame to be described below.

Note, as shown in FIG. 1, the frame member 352*a* has an inclined surface 352*b* formed thereon in the same way as prior art so that rough powder on the sifter net 351 is liable to drop into the rough powder dropping port.

Figure 3:
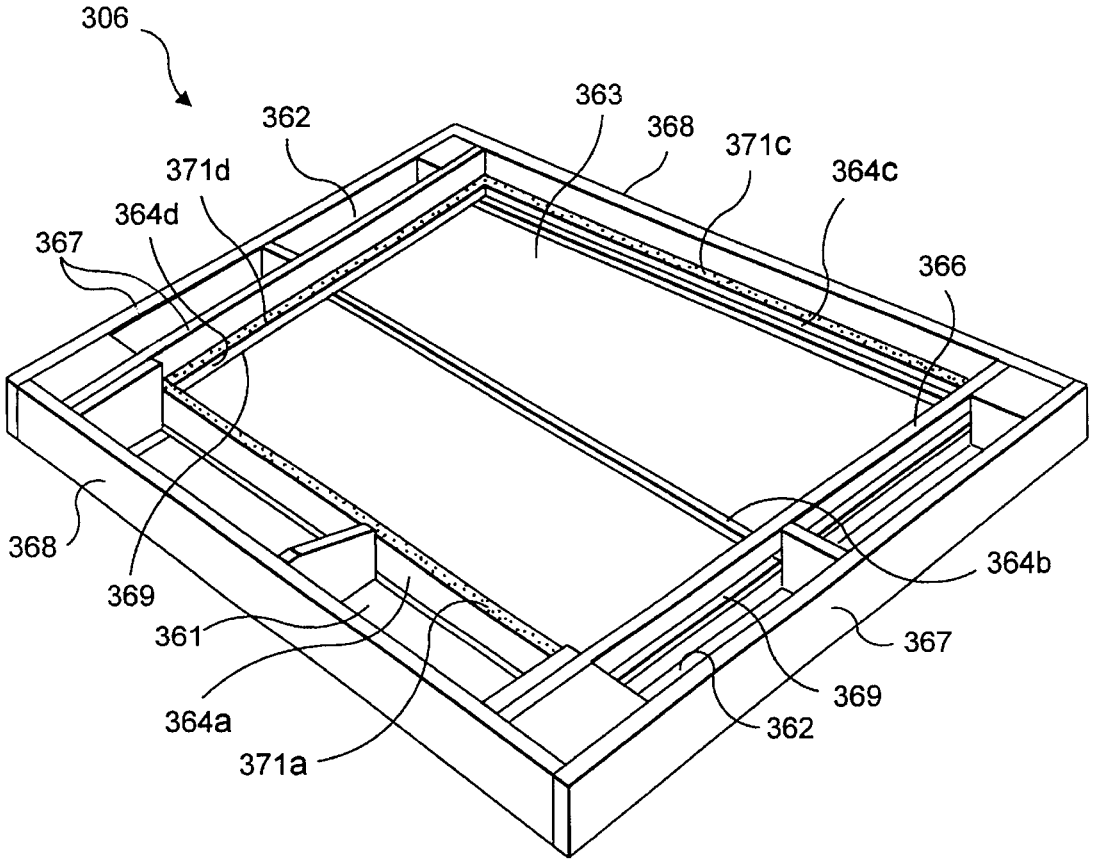
FIG. 3 is an outside perspective view of an outer frame constituting the sifter frame of the embodiment 1.
Figure 4:
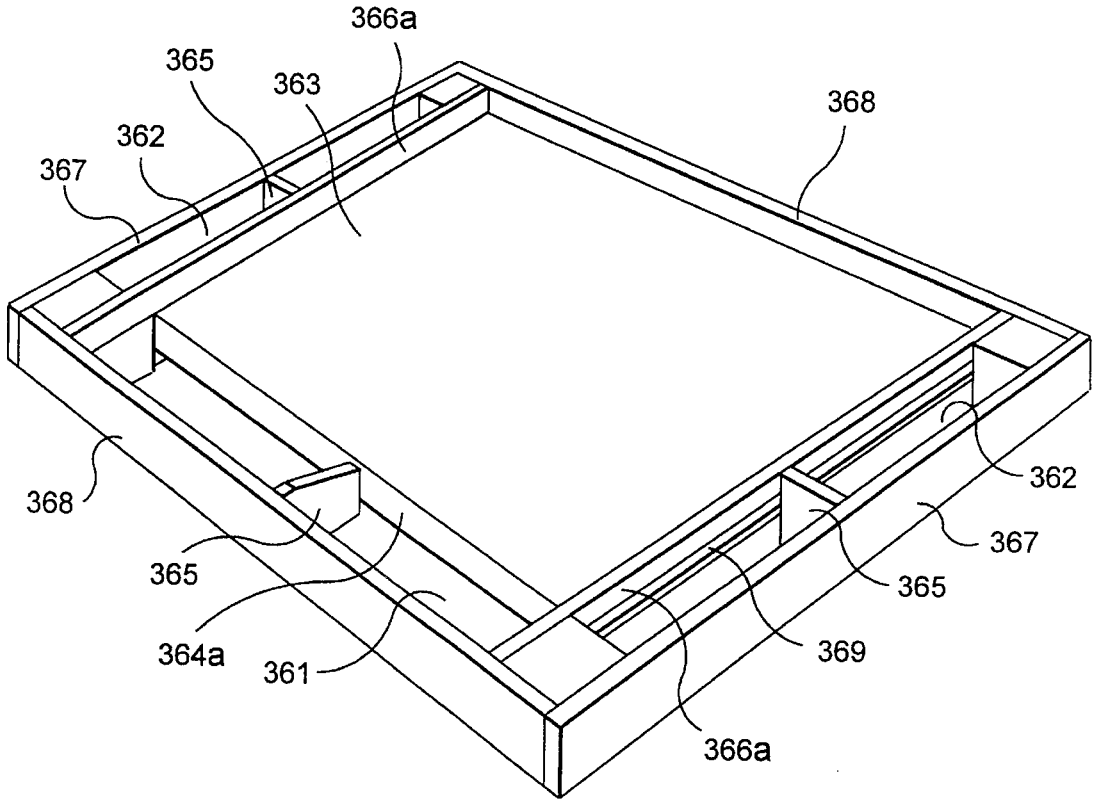
FIG. 4 is an outside perspective view of the outer frame observed from a lower side.
Figure 5:
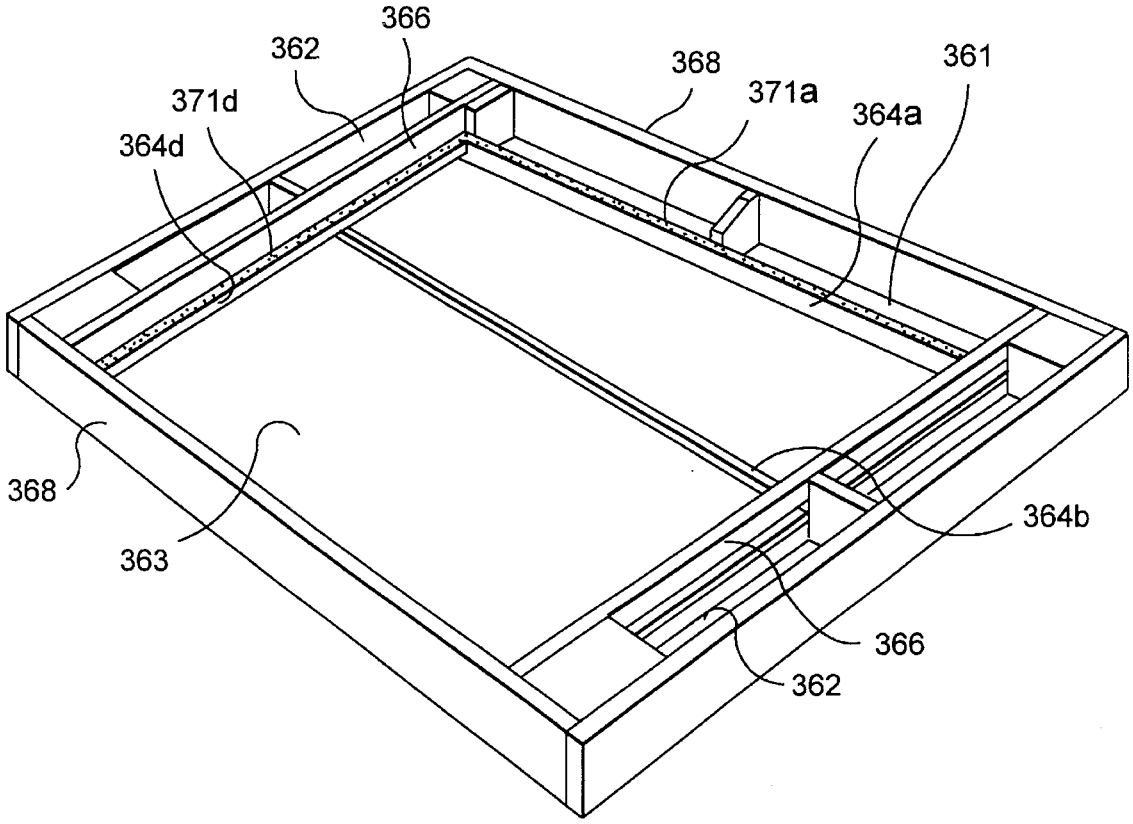
FIG. 5 is an outside perspective view of the outer frame observed from the inside of FIG. 3.

FIG. 3–FIG. 5 show the outer frame 306 of the embodiment whose arrangement is substantially the same as that of the conventional sifter frame except the structure of a frame portion with which the above inner frame 305 is internally fitted. That is, the outer frame 306 is composed of a rectangular (square in the embodiment) four-sided frame including a pair of confronting inner partition walls 366, a pair of outer side walls 367 disposed outwardly of the inner partition walls 366 and forming fine powder dropping ports 362 together with the inner partition walls 366, another pair of confronting outer side walls 368, and a receiving plate 363 as a fine powder flowing plate for introducing fine powder (through) having passed through the sifter net 351 of the inner frame 305 to the fine powder dropping port 62. Numeral 365 denotes intermediate brackets for connecting the inner partition walls 366 to the outer side walls 367, 368.

The receiving plate 363 of the embodiment is composed of a rectangular stainless steel sheet fixed to the lower surfaces of three parallel wood bars 364 by screws, and these three wood bars 364 are disposed as described below. That is, as shown in FIG. 3–FIG. 5 (particularly refer to FIG. 5 showing a view observed from the inside opposite to FIG. 3), the first wood bar 364*a* as a square bar having a predetermined height adjacent to the rough powder dropping port 361 of FIG. 3 has upper corners at the ends in the longitudinal direction thereof each formed to a stepped shape by being cut out at a predetermined height. The second wood bar 364*b* at the center is provided as a square bar having a height corresponding to the lower stepped portion of the first wood bar 364*a*. The third wood bar 364*c* on the opposite side is composed of a stepped square bar having a lower step whose height corresponds to the lower stepped portion of the first wood bar 364*a* and an upper step whose height corresponds to the total height of the first wood bar 364*a* with the lower step directed inwardly. Then, a square bar 364*d*, which has a size such that the upper surface thereof is flush with ceiling surfaces of the first and third wood bars 364*a*, 364*c*, is disposed from the stepped portion of each of the ends of the first wood bar 364*a* to each of the lower steps of the third wood bar 364*c* while coming into contact with the upper surface of the second wood bar 364*b*. Consequently, there are formed rectangularly annular seal surfaces 371*a*, 371*c*, 371*d* which are positioned on the same plane as a whole.

Note, numeral 369 denotes slit-shaped fine powder dropping ports defined between the receiving plate and the inner partition walls 366.

The frame portion composed of the inner partition walls 366 and the receiving plate 363 as described above is supported by the inner partition walls 366 located under the receiving plate and support bars 366*a* separately disposed in parallel with each other in an upward/downward direction at a predetermined height from the lower surface of the outer frame (particularly refer to FIG. 4 observing the outer frame from the lower side thereof), whereby a space is formed on the lower side of the receiving plate 363 to enable rough powder to flow on the sifter net of a lower stage.

Figure 6:
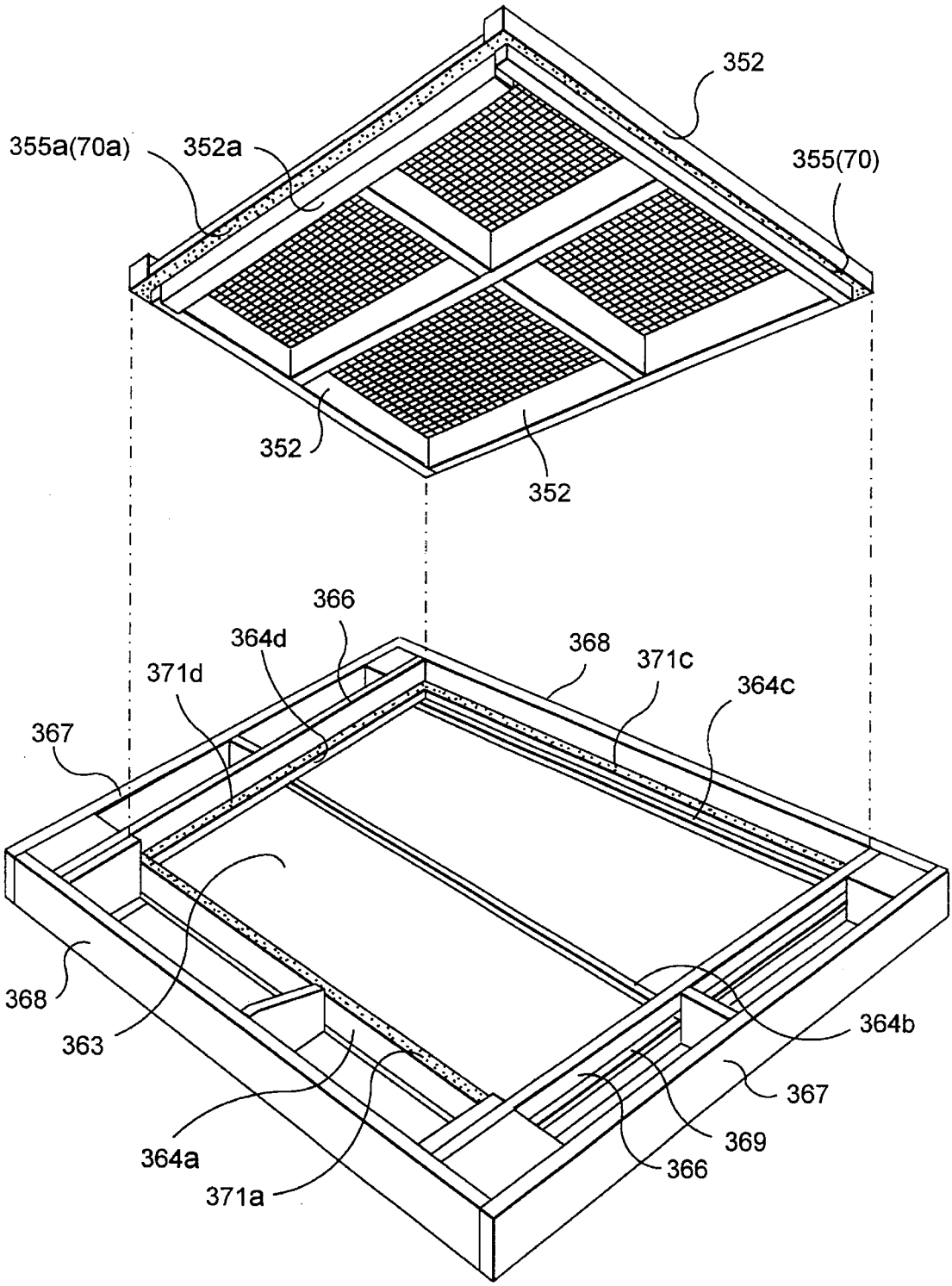
FIG. 6 is an unfolded view showing a state the inner frame of the embodiment 1 is engaged with the outer frame thereof.

FIG. 6 shows a state that the inner frame 305 is fitted with the frame portion of the outer frame 306 each arranged as described above. More specifically, the stepped lower portion of the inner frame 305 is fitted with the inside of the frame portion formed by the receiving plate 363, the inner partition walls 366 and the like, so that the seal surfaces 370, 370*a* of the lower surfaces of the upper flanges 354, 354*a* come into contact with the respective seal surfaces 371*a*, 371*c*, 371*d* of the outer frame 306.

Figure 7:
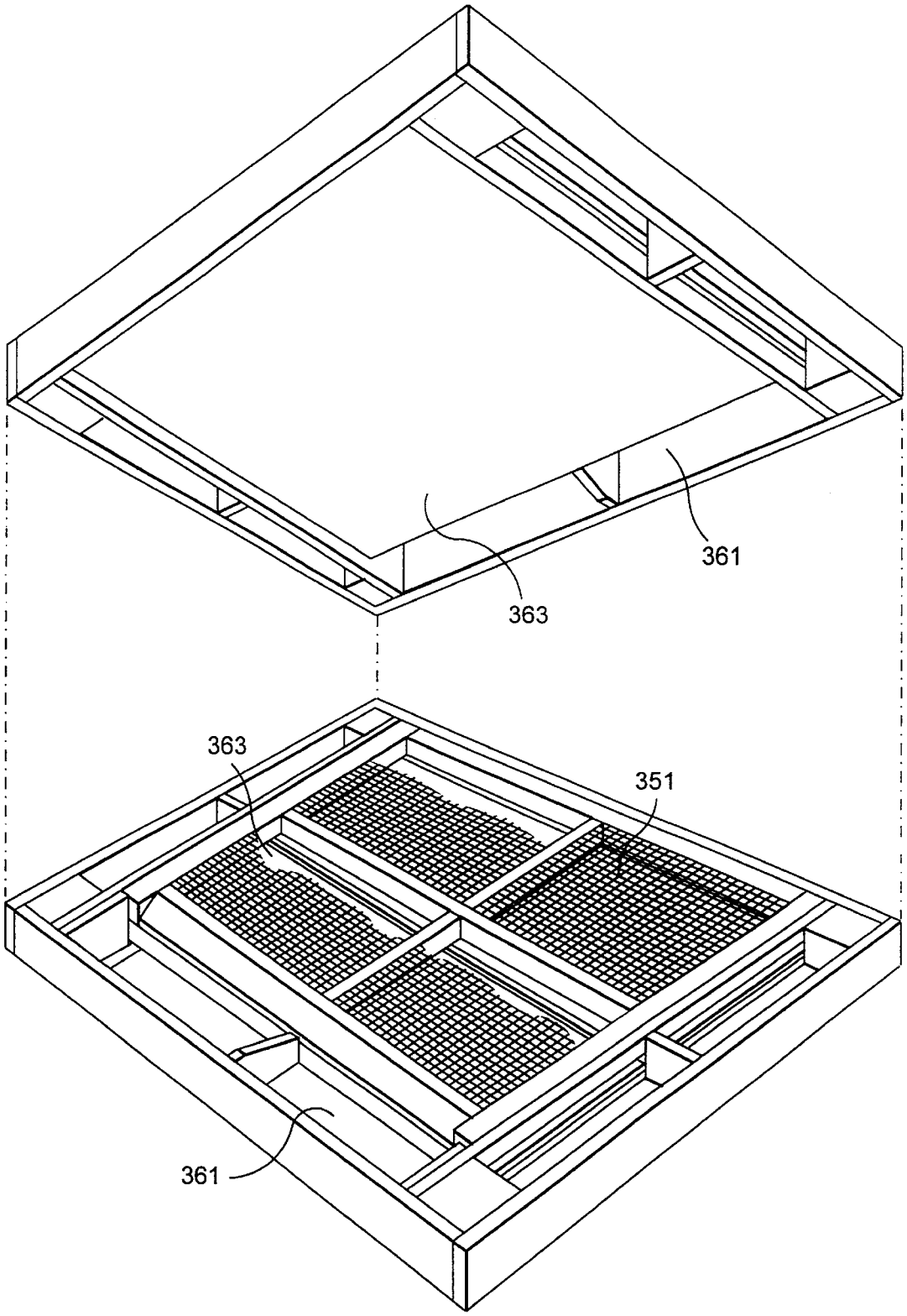
FIG. 7 is a view showing a relationship of engagement when the sifter frames of the embodiment 1 are stacked in an upward/downward direction.

With this arrangement, the annular seal surfaces 370, 370*a*, which are located on the same plane, of the inner frame 305 come into contact with the annular seal surfaces 371*a*, 371*c*, 371*d*, which are located on the same plane, of the outer frame 306 confronting the inner frame 305. When sifter frames each composed of the inner frame 305 fitted with the outer frame 306 are successively stacked with the rough powder dropping ports thereof disposed alternately as shown in FIG. 7 and strongly pressed from the upper and lower sides, the seal surfaces in contact with each other are caused to firmly come into contact with each other under pressure, whereby a rough powder region is securely partitioned and sealed from a fine powder region. Note, since the outer frame of the sifter frame of the upper stage strongly presses the inner frame and outer frame of a sifter frame of the lower stage under strong pressure applied vertically, the seal surfaces 370, 370*a* are caused to firmly come into contact with the confronting seal surfaces 371*a*, 371*c*, 371*d* under pressure.

When a multiplicity of the sifter frames each arranged as described above are stacked in an upward/downward direction and rough power is supplied onto the sifter net of the uppermost sifter frame while the sifter frames are caused to make a circular motion on a horizontal surface, the rough powder drops onto the sifter net of the next stage from the rough powder dropping port 361 while moving on the sifter net 351, then moves on the sifter net 351 of the next stage to the rough powder dropping port 361 located on the opposite side and further drops onto the sifter net of the next stage. Then, the rough powder is discharged to the outside of the system through the lowermost sifter frame while meandering with the successive repetition of the above operation. On the other hand, fine powder having passed through the sifter nets 351 of the respective stages drops onto the receiving plate 363, then drops into the fine powder dropping ports 362 from the right and left slit-shaped fine powder dropping ports 369 and is introduced to a fine powder collection path.

According to the sifter using the sifter frames of the embodiment arranged as described above, since the seal surfaces for partitioning and sealing the rough powder region from the fine powder region are formed as closed curve type annular surfaces located on the same plane, portions on which an contact pressure applying force does not act, which is found in prior art, do not exist anywhere, so that an intimate contact seal can be securely realized.

According to the result of a test for sifting and separating flour using the sifter frames arranged as described with reference to FIG. 1–FIG. 7, it was confirmed that the mixture of rough particles with fine powder could be completely prevented.

Note, needless to say, the sifting and separating operation effected using the sifter frames of the embodiment is not limited to flour but applicable to the separation of any appropriate powder particles such as starch, ceramics and the like (which is applicable to embodiments to be described below).

Embodiment 2

Figure 8:
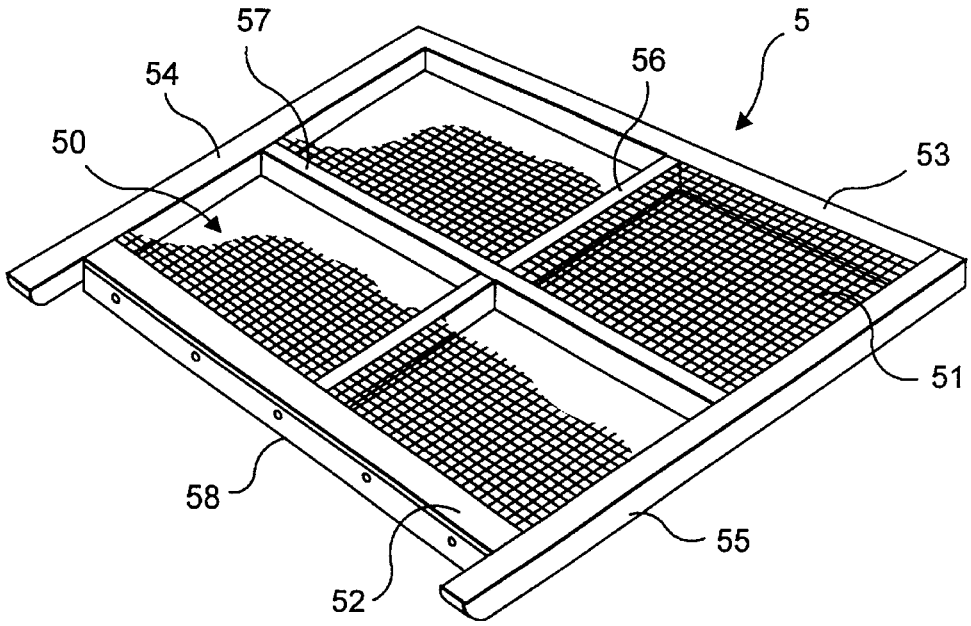
FIG. 8 is an outside perspective view of an inner frame constituting a sifter frame of an embodiment 2 of the present invention.
Figure 9:
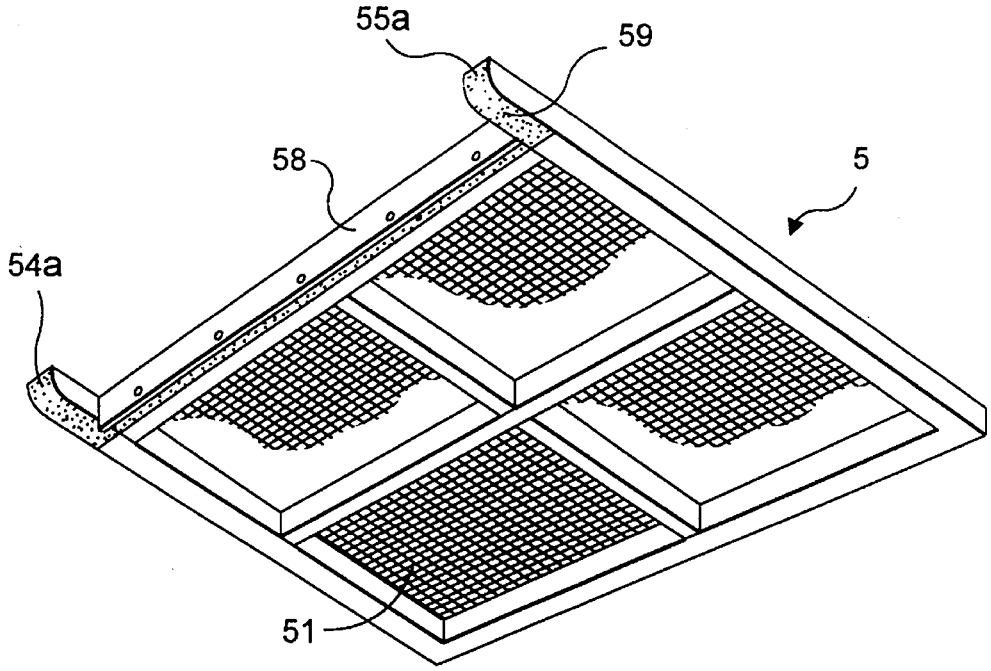
FIG. 9 is an outside perspective view observing the inner frame from a lower side.

In a sifter frame of the embodiment 2 described with reference to FIG. 8–FIG. 17, numeral 5 in FIG. 8 and FIG. 9 denotes an inner frame composed of a substantially rectangular four-side frame which are formed from outer block frame members 52, 53, 54, 55 each composed of, in the embodiment, a wood square column member and sifter net region 50 is formed in the inner frame 5. Reinforcing wood bars 56, 57 formed to cross shape are disposed between the frame members 52 and 53 and the frame members 54 and 55, respectively and a sifter net 51 is stretched over the ceiling surfaces of the frame members 52, 53, 54, 55 and the reinforcing wood bars 56, 57. Note, the frame members 52–55 are arranged such that the upper surfaces thereof are flush with the lower surfaces thereof as well as the frame member 52 is composed of a square column member having a larger cross sectional area so that the frame member 52 has a modulus of section larger than those of the other three frame members 53–55. A reason why the upper surfaces of the inner frame is formed to have the same level is to make surfaces, which are to be sealed when sifter frames are stacked to multi-stages, flat. Further, a reason why the frame member 52 is composed of the square column member having a cross sectional area larger than those of the other three frame members is that a maximum bending rigidity is required to the frame member 52.

One of the features of the inner frame 5 of the embodiment is that when the inner frame 5 is fitted with an outer frame to be described later, a thin flat metal bar 58 is fixed to the front side surface of the frame member 52 which is to be in contact with a rough powder dropping port (69 to be described later) by means of screws or the like and further that the lower end of the flat bar 58 projects further downwardly of the lower surface of the frame member 52 a predetermined distance (refer to FIGS. 8, 9). A reason why the flat metal bar 58 is mounted on the front side surface of the frame member 52 in the embodiment is to securely prevent the invasion of rough powder into fine powder through engaging surfaces where the frame member 52 of the inner frame is engaged with the receiving stand (82 to be described later) to the outer frame which is provided to place the frame member 52 thereon in such a manner that the end surface of the above engaging surfaces facing to the rough powder dropping port on the engaging surface is covered with the flat metal bar 58 as described above. A packing may be interposed between the flat bar 58 and the frame member 52.

Further, the embodiment employs a characteristic arrangement that the extreme (front) ends of the right and left frame members 54, 55, which are to be in contact with fine powder dropping ports (65 to be described later) when the inner frame 5 is fitted with the outer frame to be described later, project to the rough powder dropping port side than the position of the frame member 52 as well as the lower corner portions of the extreme (front) ends of the right and left frame members 54, 55 are formed to convex arc-shaped surfaces 54*a*, 55*a*. Further, it is also one of the features of the embodiment that elastic seal packing members 88 each having a predetermined uniform thickness are applied to the convex arc-shaped surfaces 54*a*, 55*a* and the lower surface of the frame member 52 shown by phantom lines. These features are shown in FIGS. 8, 9 and FIG. 13–FIG. 15 in more detail.

A reason why the above arrangement is employed in the embodiment is to form seals surface on which a compression force (depressing force) acts in an upward/downward direction while enabling the easy and smooth mounting and dismounting of the inner frame on and from the outer frame in such a manner that the lower corner portions at the extreme ends of the frame members 54, 55 are formed to the convex arc-shaped surfaces 54*a*, 55*a* engaged with the concave arc-shaped surfaces 82*a*, 82*a* of the outer frame corresponding thereto in order to that the invasion of rough powder into a fine powder region from the rough powder dropping port is securely prevented. The elastic seal packing members are applied to further improve the sealing property of the engaging surfaces.

Note, the sifter frame of the embodiment is similar to the conventional sifter frame except the above characteristic arrangement, and, for example, a crimp net may be stretched in the vicinity of the lower side of the sifter net 51 in parallel therewith with a cleaner (both not shown) movably interposed between the nets to prevent the clogging of the net.

Figure 10:
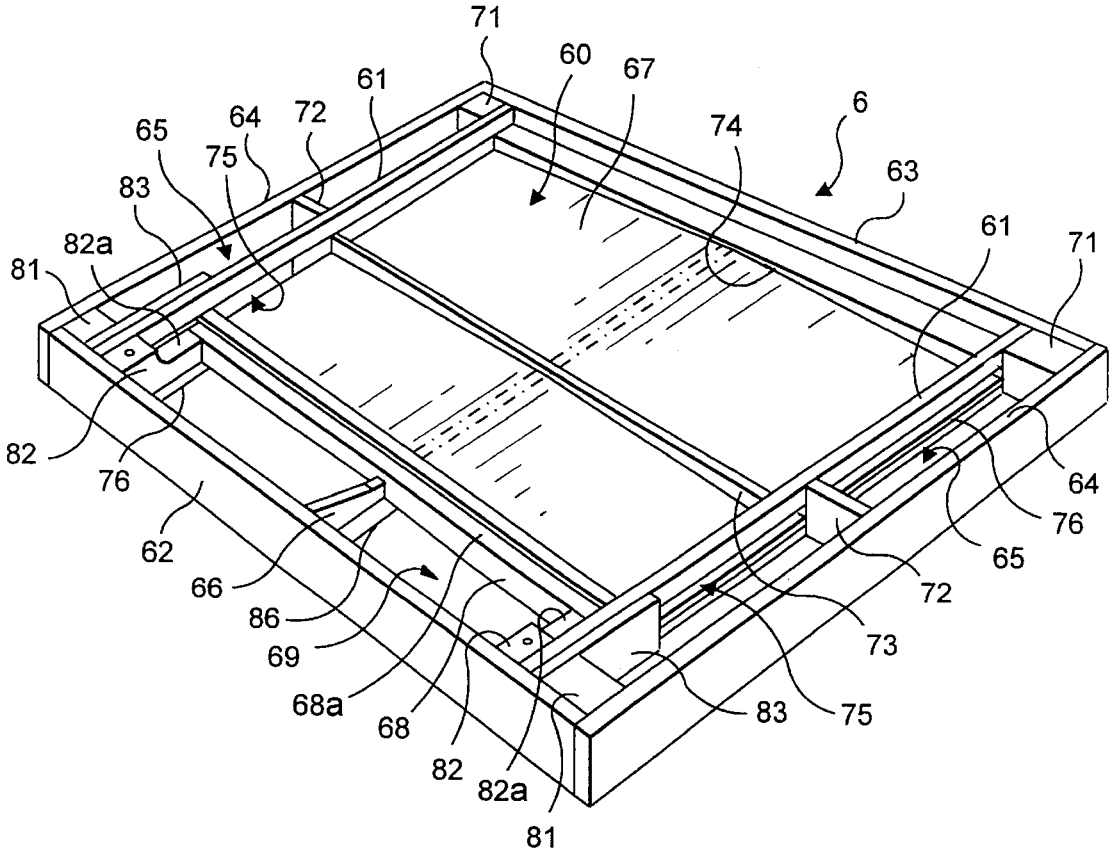
FIG. 10 is an outside perspective view of an outer frame constituting the sifter frame of the embodiment 2.
Figure 11:
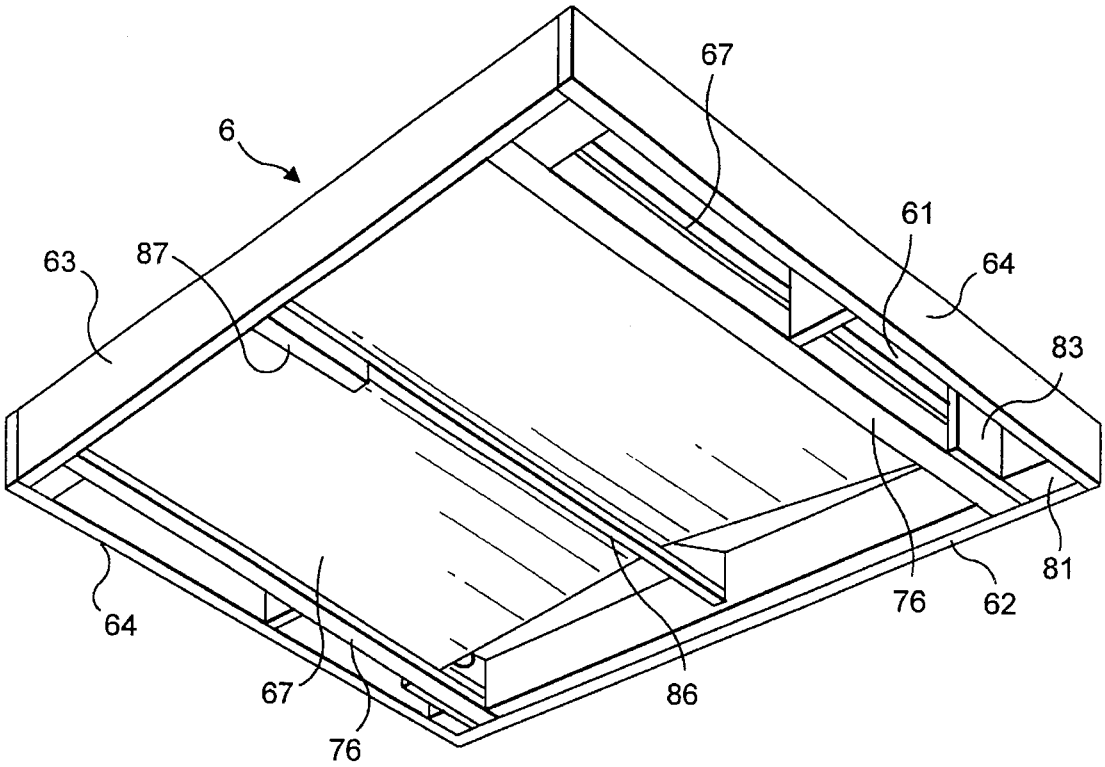
FIG. 11 is an outside perspective view of the outer frame observed from a lower side.

FIG. 10 and FIG. 11 show the outer frame 6 constituting the sifter frame of the embodiment. The outer frame 6 is formed to a rectangular four-sided frame formed by outer side walls (outer block members) 62, 63, 64, 64 each composed of a wood sheet. A pair of inner side walls 61, 61 each composed of a flat metal bar are disposed between the outer side walls 62, 63 spaced apart from the outer side walls 64, 64 in parallel therewith so that the fine powder dropping ports 65, 65 are defined to the inside of a pair of the confronting outer side walls 64, 64 of the above outer side walls 62, 63, 64, 64, and further a pair of receiving stands (inner frame extreme end projection receiving stands) 82, 82 each composed of a resin member are disposed at the both ends (inside surfaces of the inner side walls 61, 61) of the rough powder dropping port 69 formed to the inside of the outer side wall 62. The receiving stands 82, 82 are provided with the concave arc-shaped surfaces 82*a*, 82*a* to and with which the convex arc-shaped surfaces 54*a*, 55*a* of the lower corner portions of the extreme ends of the frame members 54, 55 of the aforesaid inner frame 5 correspond and are engaged.

A recessed portion 60 into and with which the above inner frame 5 is inserted and fitted substantially in close contact therewith is formed by the outer side wall 63, a pair of the inner side walls 61, 61 and a pair of the receiving stands 82, 82. Note, numeral 68 denotes a partition wall for partitioning a fine powder receiving region provided with a receiving plate 67 from the rough powder dropping port 69 defined to the inside of the outer side wall 62 and the partition wall 68 also serves as a receiving plate on which the frame member 52 of the inner frame is to be place. Then, the rough powder dropping port 69 is formed as a space region surrounded by the partition wall 68, a pair of the receiving stands 82 and the outer side wall 62 in parallel with the partition wall 68 and passing through in an upward/downward direction.

In the embodiment, the fine powder receiving region is formed in such a manner that inner frame receiving stands 73, 74 each composed of a wood bar as high as the partition wall 68 are disposed between a pair of the inner side walls 61, 61 on the lower surfaces thereof as well as a rectangular stainless steel receiving plate 67 is attached and fixed to the lower surfaces of the inner frame receiving stands 73, 74 by wood screws. Note, in the embodiment, the receiving plate 67 is high at the central portion thereof in a right/left direction (direction in which the fine powder dropping ports 65, 65 are spaced apart from each other) and forms gently descending inclinations toward the right and left directions (toward the fine powder dropping ports 65), whereby fine powder having passed through the sifter net 51 promptly drops into the fine powder dropping ports 65.

Lower inner side walls 76, 76 constituting a pair in a vertical direction with the inner side walls 61, 61 are disposed under both the right and left ends of the receiving plate 67 and the lower surfaces of the lower inner side walls 76, 76 are flush with the lower surfaces of the outer side walls 62, 63, 64 and extend over and cover the upper surfaces of the inner side wall 61 of the outer frame of a sifter frame stacked to the lower stage and the inner frame member 54 (or 55).

Note, the inner frame receiving stand 74 is disposed in contact with the outer side wall 63 and the other inner frame receiving stand 73 is disposed at an intermediate position between the partition wall 68 and the inner frame receiving stand 74.

With the above arrangement, the receiving plate 67 provides a space for the fine powder region for receiving fine powder (through) having passed through the sifter net 51 of the inner frame 5 inserted into and fitted with the inner frame fitting portion. The fine powder is dropped into the fine powder dropping ports 65 from slit-shaped fine powder dropping ports 75 each defined between the lower surface of the inner side wall 61 and the receiving plate 67.

The upper surface of the partition wall serving also as the inner frame receiving stand 68 and the upper surfaces of the inner frame receiving stands 73, 74 in the inner frame fitting portion 60 are located at such a position of depth that when the inner frame 5 is placed on the above surfaces by being inserted into and fitted with the inner frame fitting portion 60, the upper surfaces of the inner side wall 61 and the outer side walls 62, 63, 64 are flush with the upper surface of the inner frame 5.

Figure 16:
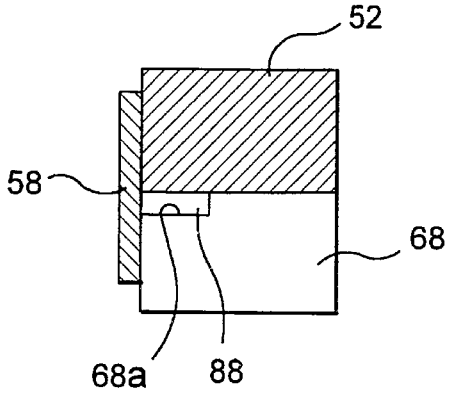
FIG. 16 is a longitudinally cross sectional side view showing a relationship of engagement of the frame member 52 of the inner frame and the partition wall 68 of the outer frame of the embodiment 2.
Figure 17:
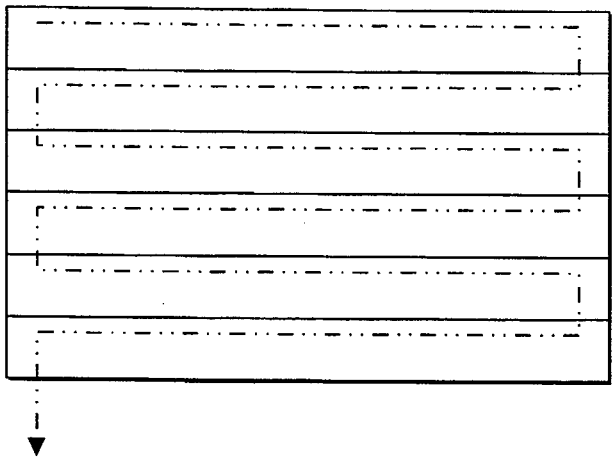
FIG. 17 is a view showing a state where powder particles to be treated move downward while meandering through sifter frames stacked to multi-stages.

The partition wall serving also as the inner frame receiving stand 68 has a predetermined width of a stepped and lowered portion at its upper corner on the rough powder dropping port 69 side. As shown in FIG. 16, the seal packing member 88 applied to the front half portion of the lower surface of the frame member 52 continuously to the convex arc-shaped surface 54*a* (55*a*) at the extreme end of the frame member 54 (55) of the inner frame 5 is engaged with the stepped lower portion 68*a* in order to that a seal property is more effectively exhibited by the seal packing member 88.

A central portion reinforcing member 86 is disposed between the outer side wall 62 and the outer side wall 63 at the center of the lower surface of the receiving plate 67 to support the receiving plate 67 from the lower surface thereof. Note, the both ends of the central portion reinforcing member 86 is fixed to the outer side walls 62, 63 and a bracket 66 is also fixed on the reinforcing member 86. Although the central portion reinforcing member 86 is used to increase the structural strength of the outer frame, since the lower side region of the receiving plate 67 is a region where rough powder moves (transfers) on the sifter net, there is a problem that it is not desirable to attach a member having a high dimension to this area. On the other hand, since the member 86 is used for reinforcement, it is desired that the member 86 has a sufficient strength and rigidity against a bending moment. To satisfy these two requirements, it is desirable in many cases to use a reinforcing member of metal which has a strength and rigidity larger than those of a wood member even if its cross sectional area is smaller than that of the wood member.

Further, the strength of the overall structure is improved in such a manner that blocks 71, 71, 81, 81 are fixed at the four corners (both ends of the fine powder dropping ports 65) of the frame constituting the rectangular four-side outer block and reinforcing intermediate brackets 72, 72 are fixed between the outer side walls 62, 63 and the inner side walls 61, 61.

Numerals 83, 83 denote partition wall brackets fixed to close the gaps between the inner side walls 61 and the lower inner side walls 76 at the both ends of the rough powder dropping port 69.

Another feature of the outer frame 6 of the embodiment is the provision of a lower stage inner frame pressing projection 87. That is, the lower stage inner frame pressing projection 87 is disposed below the central portion reinforcing member 86 in such a manner that an end of the projection 97 is fixed to the outer side wall 63 and the lower surface thereof is flush with the lower surfaces of the side walls 62, 63, 64. With this arrangement, the central portion of the frame member 52 of the inner frame of a sifter frame stacked to the lower stage is depressed downwardly. Note, it is preferable that the length of the lower stage inner frame pressing projection 87 is set to such a length that the extended end of the projection reaches the upper surface of the frame member 52 of the inner frame of the lower stage but does not reach the sifter net 51 thereof.

With the provision of the lower stage inner frame pressing projection 87, the central portion of the frame member 52 of the inner frame of the sifter frame stacked to the lower stage receives a vertically downward depressing force, so that a sealing force, which is produced on the engaged seal surfaces between the frame member 52 of the inner frame and the partition wall also serving as the receiving stand 68 of the outer frame to be fitted with each other, can be obtained at the central portions of these members and thus a sufficient seal effect can be secured.

Figure 12:
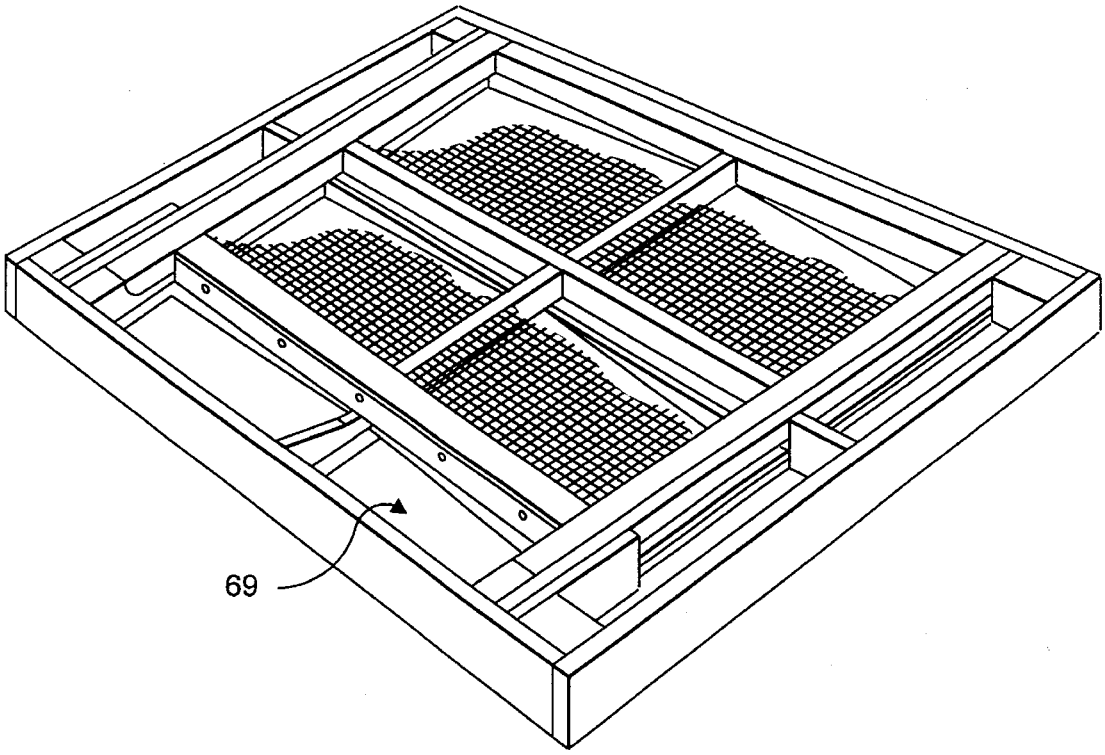
FIG. 12 is an outside perspective view showing a state where the inner frame of the embodiment 2 is engaged with the outer frame thereof.
Figure 13:
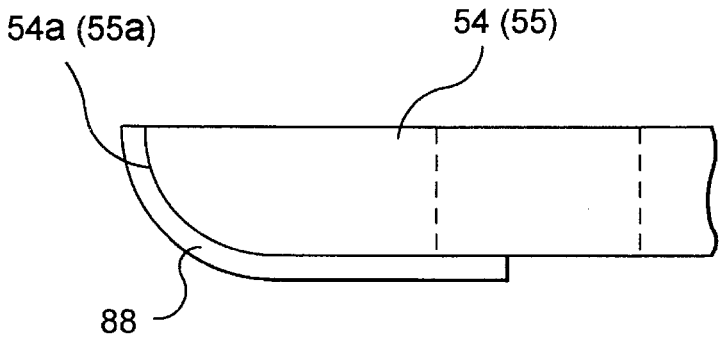
FIG. 13 is a side view showing the extreme end shape of the frame members 54, 55 of the inner frame of the embodiment 2.
Figure 14:
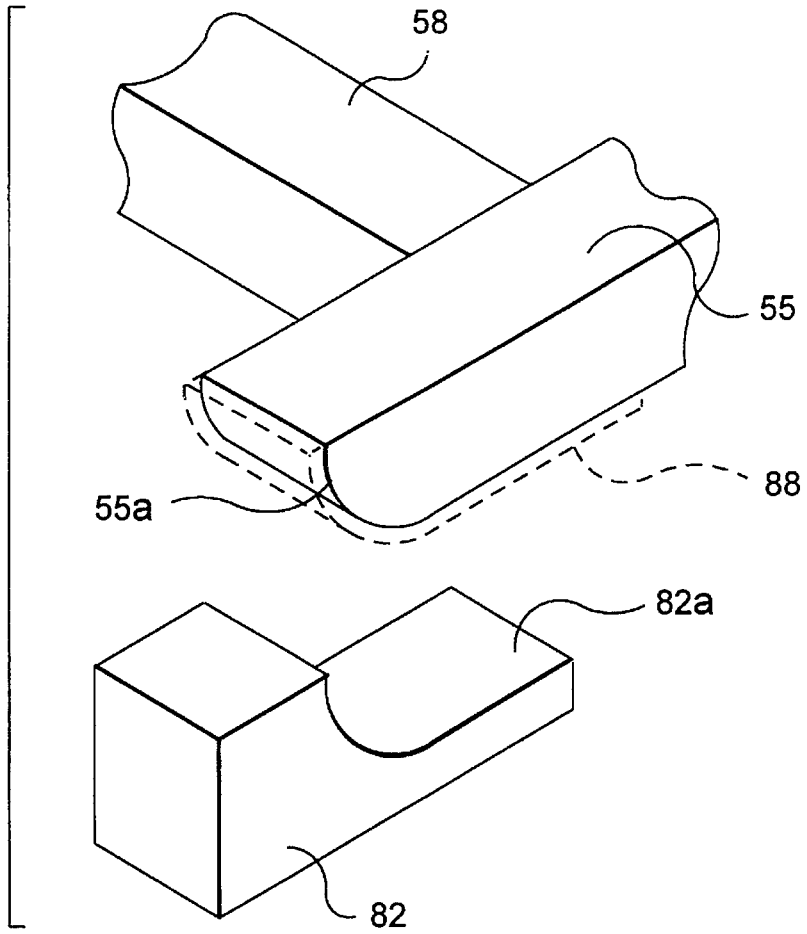
FIG. 14 is a perspective view showing a relationship of the engagement of the extreme end portions of the frame members 54, 55 of FIG. 13 with an outer frame receiving stand.
Figure 15:
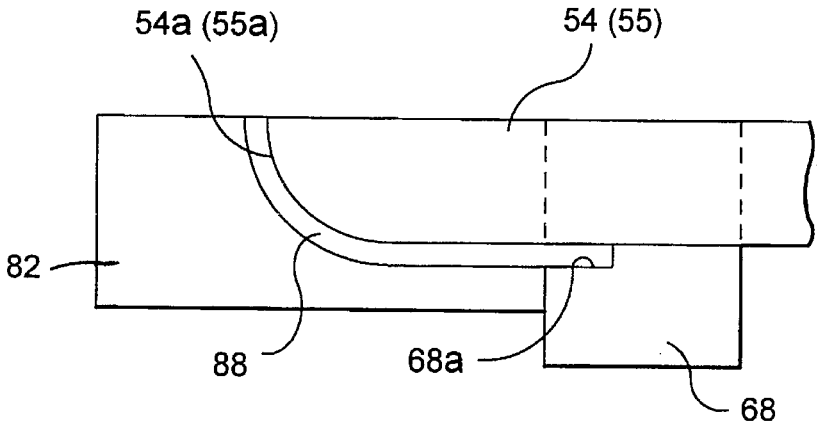
FIG. 15 is a longitudinally cross sectional side view explaining a state of engagement of the extreme end portions of frame members 54, 55 of FIG. 13 with the frame receiving stand 82 of an outer frame.

FIG. 12 shows a state assembly of a sifter frame formed by fitting the inner frame 5 with the outer frame 6 each described above. A multiplicity of the sifter frames each assembled as shown in FIG. 12 are successively stacked with the forward/rearward directions thereof disposed alternately (with the positions of the rough powder dropping ports 69 disposed alternately in the forward/backward direction) to arrange a sifter. With this arrangement, powder to be treated moves along a meandering path shown by a two-dot-and-dash-line shown in FIG. 10 so as to sift and separate fine powder contained in the powder to be treated.

Embodiment 3

Figure 18:
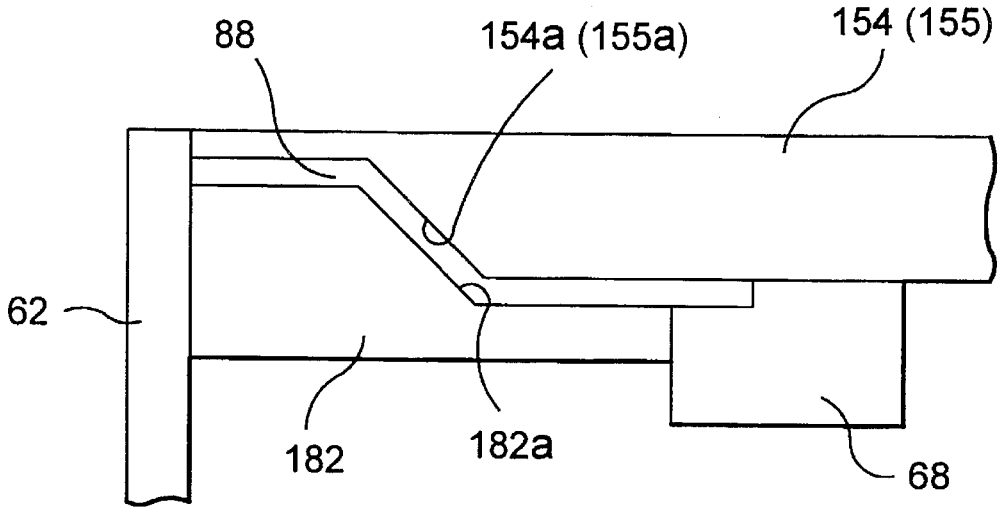
FIG. 18 is a side view showing a relationship of engagement of the extreme end portions of the frame members of an inner frame with the receiving stand of an outer frame of an embodiment 3.

The embodiment 3 shown in FIG. 18 has a feature that the lower corner portion at the extreme end of a projection projecting to the rough powder dropping port 69 of a pair of the frame members 154, 155 of an inner frame is formed to an inclined (taper) seal surface 154*a* (155*a*; the engaging surface of a corresponding receiving stand 182 is denoted by 182*a*) instead of that it is formed to the arc-shaped surface 354*a* (355*a*) of the embodiment 1, and the other arrangement of the embodiment 3 except the above is similar to that of the embodiment 1.

With the arrangement of the embodiment, since a sealing force acts on the inclined engaging surfaces in an upward/downward direction, an effect similar to that of the embodiment 2 can be obtained, i.e., the invasion of rough powder into a fine powder region can be securely prevented.

Embodiment 4

Figure 19:
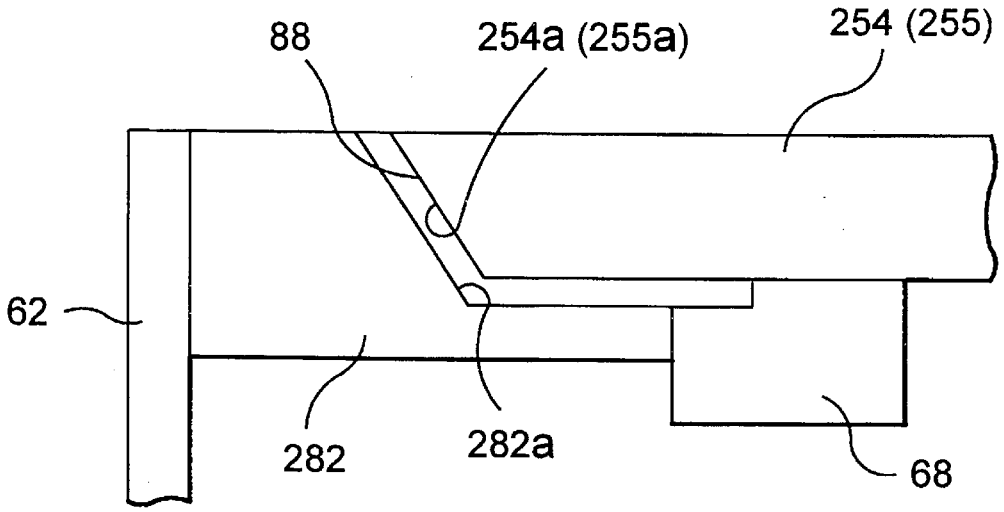
FIG. 19 is a side view explaining a relationship of engagement of the extreme end portions of the frame members of an inner frame with the receiving stand of an outer frame of an embodiment 3.

The embodiment 4 shown in FIG. 19 has a feature that the lower corner portion at the extreme end of a projection projecting to the rough powder dropping port 69 of a pair of frame members 254, 255 of an inner frame is formed to an inclined (taper) seal surface 254*a* (255*a*; the engaging surface of a corresponding receiving stand 282 is denoted by 282*a*) instead of that it is formed to the arc-shaped surface 354*a* (355*a*) of the embodiment 1, and other arrangement of the embodiment 4 is similar to that of the embodiment 2.

With the arrangement of the embodiment, since a sealing force is an upward/downward direction acts on the inclined engaging surfaces, an effect similar to that of the embodiment 2 can be obtained, i.e., the invasion of rough powder into a fine powder region can be securely prevented.

Embodiment 5

Figure 20:
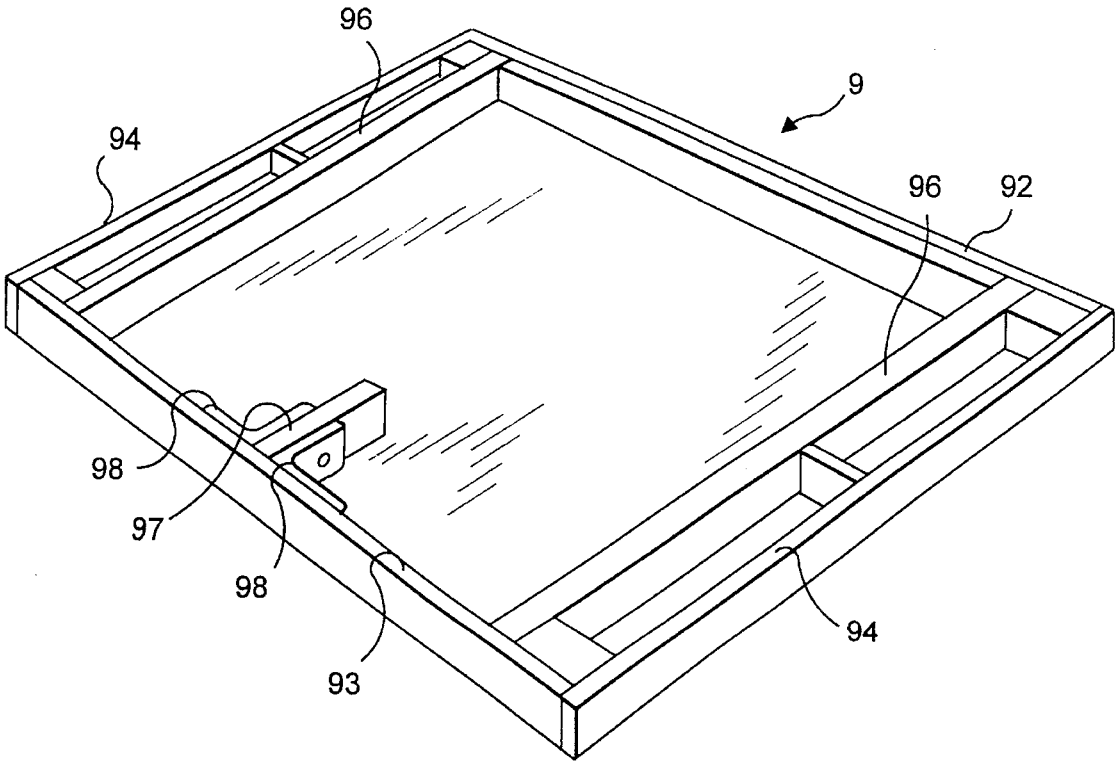
FIG. 20 is an outside perspective view showing an arrangement of an empty frame of embodiment 5.

The embodiment 5 of FIG. 20 shows an example using an empty frame 9 which is used when a large amount of powder is to be sifted and separated.

When there is a requirement for charging a large amount of powder particles onto a sifter surface to increase an amount of the powder particles to be treated, a spacer frame generally called an "empty frame" is conventionally stacked on (or under) a sifter frame of each stage to be assembled.

Figure 21:
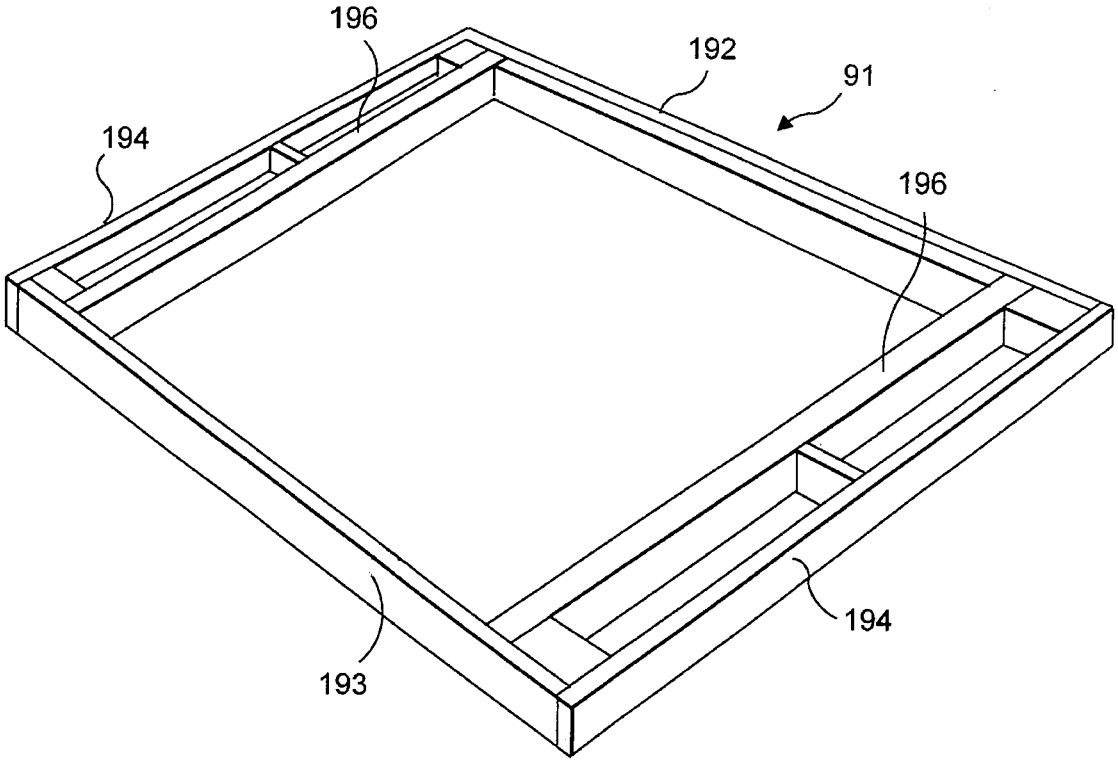
F I G. 21 PRIOR ART
FIG. 21 is an outside perspective view showing an arrangement of an empty frame of prior art.

FIG. 21 shows a conventional empty frame 91 which is formed to include a rectangular outer block formed by four outer block members 192, 193, 194, 194. The empty frame 91 only includes inner side walls 196, 196 therein for partitioning a region where powder to be treated moves from the fine powder dropping ports of sifter frames of the upper and lower stages. A space (region) for accommodating powder moving on the sifter surface can be increased by stacking the empty frames while maintaining the state of the empty frames sealed against the fine powder dropping ports, and therefore an amount of powder to be treated can be increased.

When the conventional empty frame 91 shown in FIG. 21 is used as it is to, for example, the sifter frame of the embodiment 2 described above, it is apparent that a depressing force cannot be transmitted from an upper stage sifter frame to the inner frame of a lower stage sifter frame. As result, the lower stage inner frame pressing projection 87 provided with the sifter frame of the embodiment 2 with much effort becomes meaningless and a sealing force cannot be obtained at the engaging portion between the frame member 52 of the inner frame 5 and the partition wall 68 of the outer frame 68.

To cope with this problem, the embodiment shown in FIG. 20 uses the empty frame 9 having the following arrangement so that the empty frame 9 can apply a suitable compression force to the seal portion.

More specifically, the empty frame 9 of the embodiment is arranged such that inner side walls 96, 96 having the same width are disposed just below the frame members 76, 76 of the outer frame 6 in correspondence therewith, and in the same way, an outer side wall 94 is disposed just below the frame member 64 of the outer frame 6 in correspondence therewith, an outer side wall 93 is disposed just below the frame member 63 of the outer frame 6, and an outer side wall 92 is disposed just below the frame member 62 of the outer frame 6, respectively. Note, brackets and the like are suitably provided to reinforce a structural strength.

A characteristic arrangement of the empty frame 9 of the embodiment resides in the provision of an inner frame pressing projection 97 just below the inner frame passing projection 87 of the outer frame 6 in correspondence therewith. With this arrangement, a depressing force can be transmitted from the inner frame pressing projection 87 of the upper stage to the frame member 52 of the inner frame of the lower stage sifter frame through the inner frame pressing projection 97 of the empty frame 9, whereby a seal effect can be maintained.

Note, the inner side wall 96 of the empty frame 9 has a thickness for enabling the lower surface of the inner side wall 96 to be extended to the upper surfaces of the inner side wall 61 and the frame member 54 (or 55) of the inner frame of a sifter frame stacked to the lower stage and to be engaged therewith when the sifter frame is stacked to multi-stages so that the inner side wall 96 exhibits an action similar to that of the lower inner side wall 76 described in FIG. 11. With this provision, when sifter frames are stacked together with the empty frames 9 interposed between respective stages of the sifter frames, an intimate contact force in an upward/downward direction can be applied to the inner frame 5 of the sifter frame of the each stage. Further, a gap between the inner side wall 61 and the frame member 54 (or 55) through which rough powder may enter a fine powder region can be securely sealed by the inner side wall 96 of the empty frame extending thereto.

When a group of the sifter frames each arranged as described above are stacked in multi-stages and rough powder is supplied onto the sifter net of the uppermost sifter frame while the sifter frames are caused to make a circular motion, the rough powder drops onto the sifter net 51 of the next stage from the rough powder dropping port 69 while moving on the sifter net 51, then moves on the sifter net 51 of the next stage to a rough powder dropping port 69 located on the opposite side in the same way and further drops onto the sifter net of the next stage. Then, the rough powder is discharged to the outside of the system through the lowermost sifter frame while meandering with the successive repetition of the above operation (refer to FIG. 17). On the other hand, fine powder having passed through the sifter nets 51 of the respective stages drops onto the receiving plate 67, then drops into fine powder dropping ports 65, 65 from right and left slit-shaped fine powder dropping ports 75 and is introduced to a fine powder collection path.

According to the sifter using the sifter frames arranged as described above, since the seal surfaces for partitioning and sealing the rough powder region from the fine powder region are formed as annular seal surfaces located on the same plane, portions on which a pressure applying force does not act, which is found in prior art, do not exist anywhere, so that an intimate contact seal can be securely realized and a possibility of the mixture of rough powder with fine powder in the fine powder region can be securely prevented.

When a test for sifting and separating flour was effected using the sifter arranged by the sifter frames having the arrangements of the embodiments 2–5, it was confirmed that the mixture of rough particles with fine powder could be completely prevented.

Embodiment 6

In FIG. 22–FIG. 26, numeral 405 denotes an inner frame which is composed of, for example, square column wood frame members 452–455 constituting a rectangular four-side frame, a partition wall 458 for partitioning the inside of the rectangular four-side frame to a sifter net region 450 and the region of a rough powder dropping port 459, reinforcing wood bars 456, 457 disposed in the sifter net region 450 to a cross shape, and a sifter net 451 stretched over the ceiling surface of the sifter net region 450. Note, a crimp net is stretched in the vicinity of the lower side of the sifter net 451 in parallel therewith and a cleaner (both not shown) is movably interposed between the nets to prevent the clogging of the net similar to the aforesaid embodiments.

Figure 22:
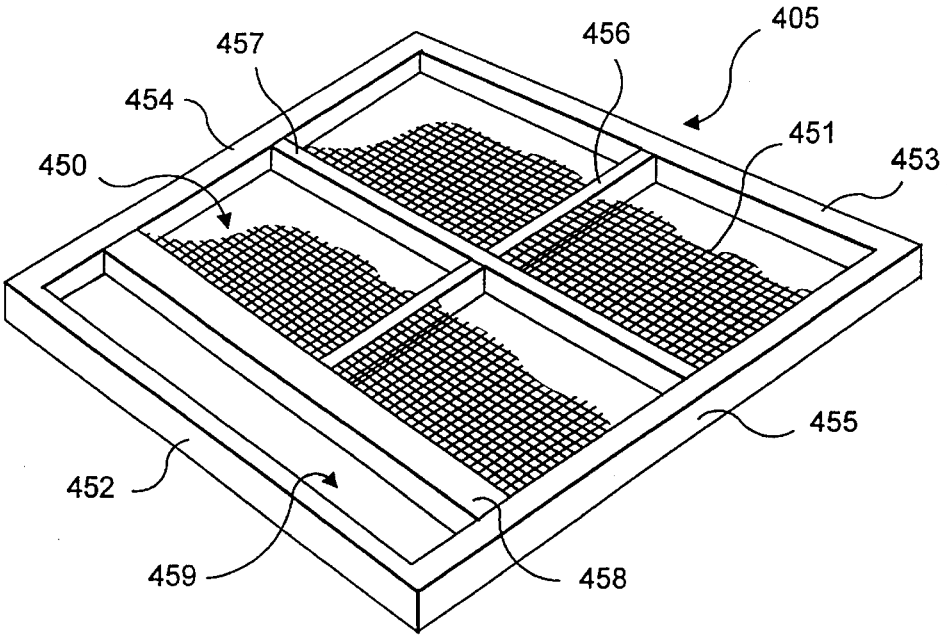
FIG. 22 is an outside perspective view of an inner frame constituting a sifter frame of an embodiment 6 of the present invention.
Figure 24:
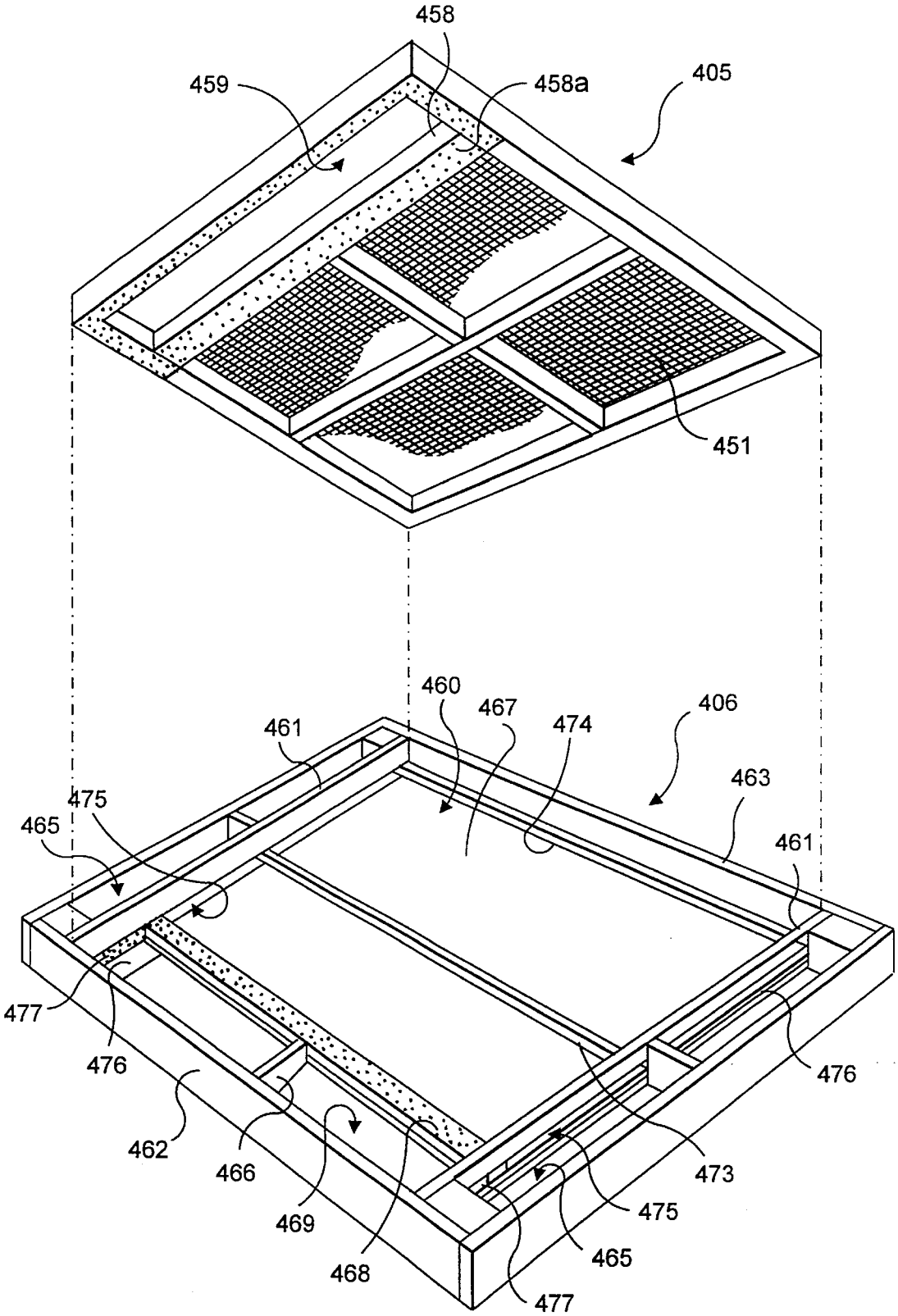
FIG. 24 is an unfolded view explaining a state that the inner frame of the embodiment 6 is fitted with the outer frame thereof.

As is apparent from FIG. 22 and FIG. 24, the inner frame 405 of the embodiment has a feature that since each of the frame members 452–455 and the partition wall 458 is composed as a square column member having the same height, the upper and lower surfaces of these frame members and the partition wall are formed to rectangularly annular surfaces and the like which are flush with each other. Another feature of the inner frame 405 of the embodiment is that the three frame members 454, 455, 458 constituting a rough powder dropping port 459 provided in the inner frame 405 have upper and lower surfaces which can be air-tightly sealed on a horizontal surface in order to that a rough powder dropping port 469, which is provided with an outer frame into and with which the inner frame 405 is to be inserted and fitted, is air-tightly partitioned.

Figure 32:
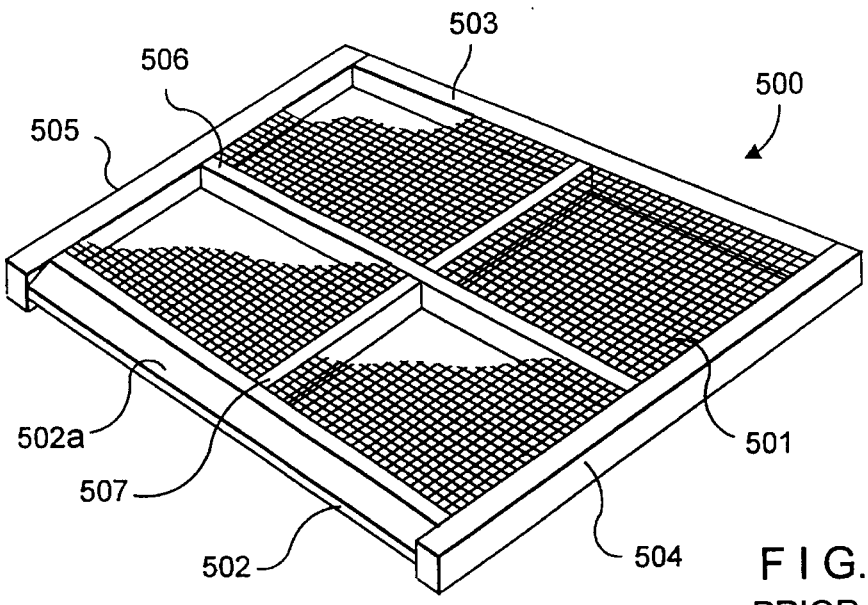
FIG. 32 PRIOR ART
FIG. 32 is an outside perspective view showing an arrangement of an inner frame constituting a sifter frame of prior art.
Figure 33:
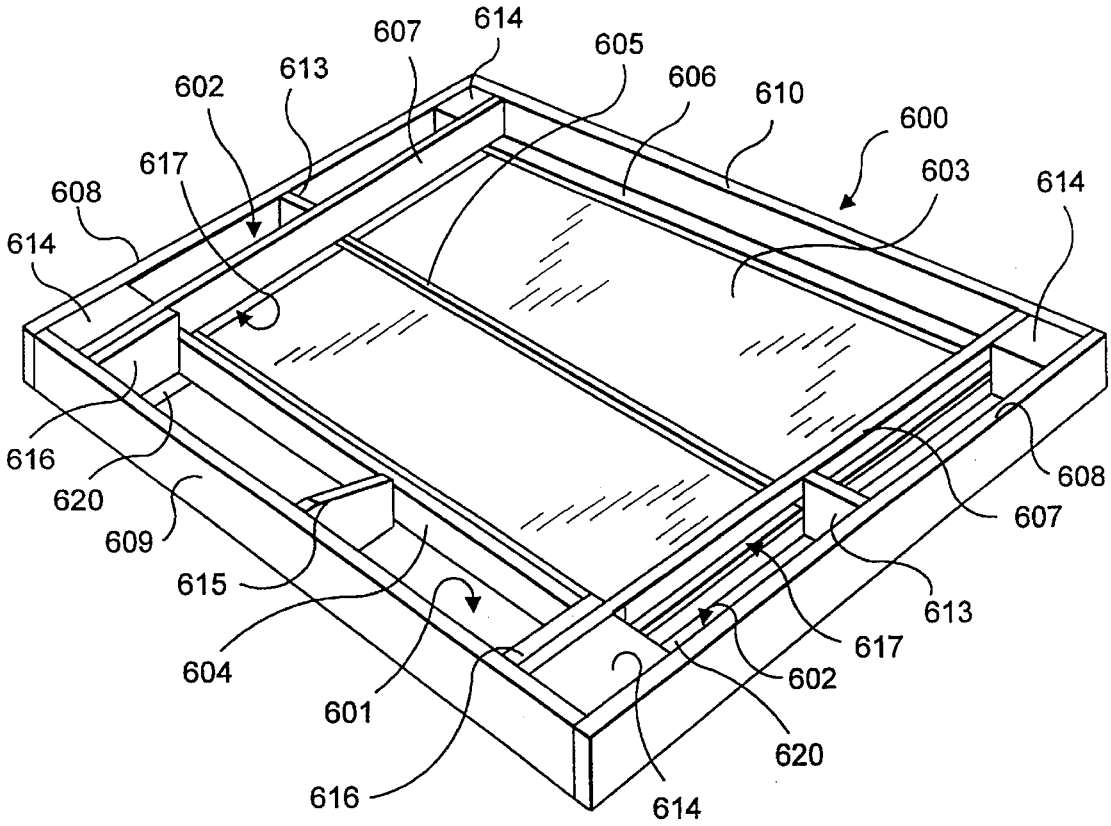
FIG. 33 PRIOR ART
FIG. 33 is an outside perspective view showing an arrangement of an outer frame constituting the sifter frame of the prior art.
Figure 34A:
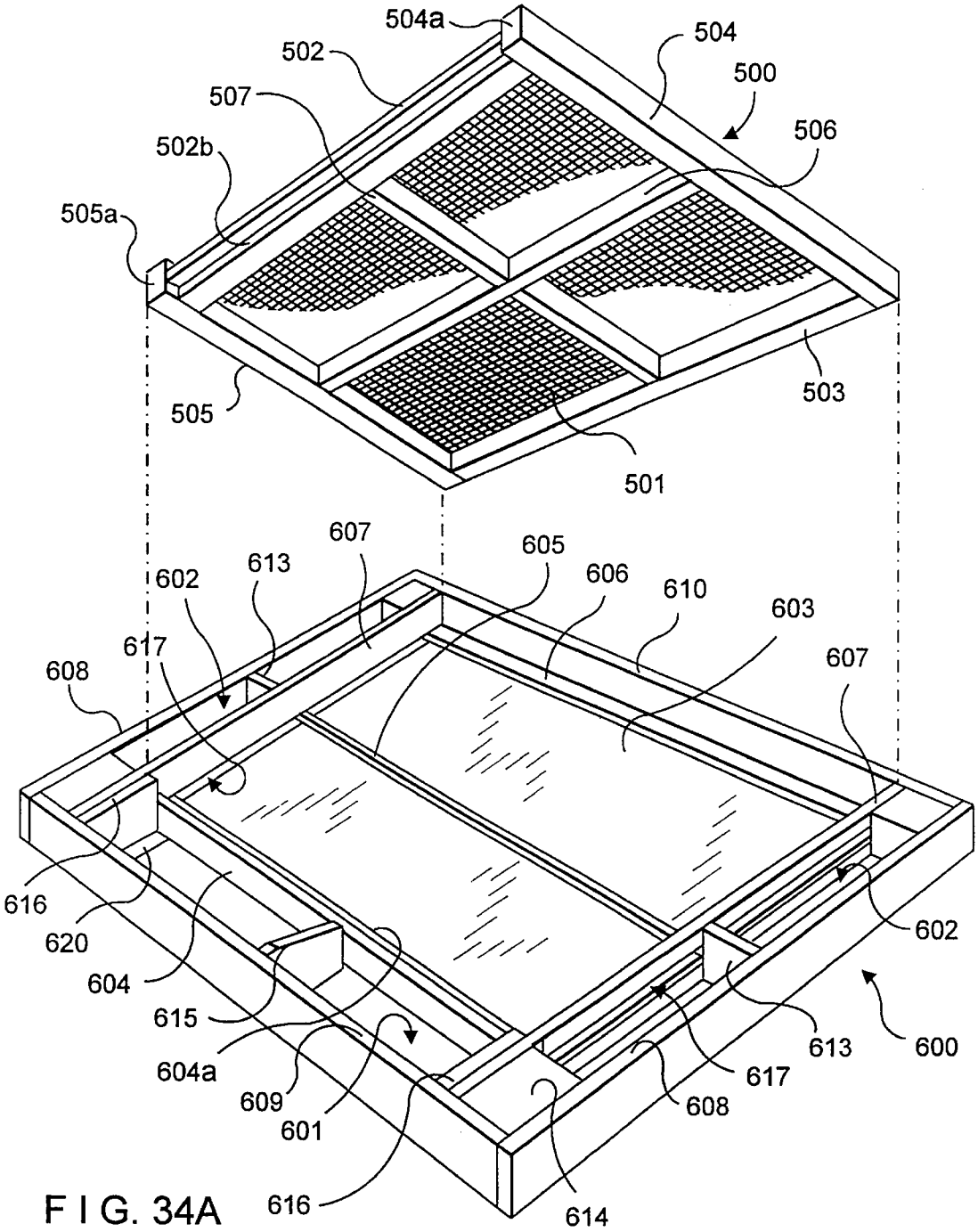
F I G. 34A PRIOR ART
FIG. 34(*a*) is an unfolded view showing a state that an inner frame and an outer frame constituting the sifter frame of the prior art are fitted with each other for assembly and FIG. 34(*b*) is a longitudinally cross sectional view showing a relationship of engagement of the frame member 502 of the inner frame with the partition wall 604 of the outer frame.
Figure 34B:
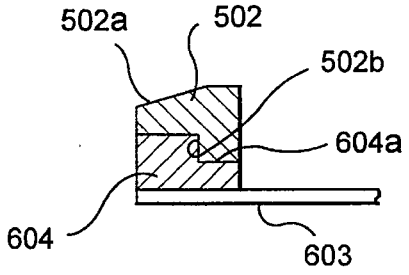
F I G. 34B PRIOR ART
Figure 35:
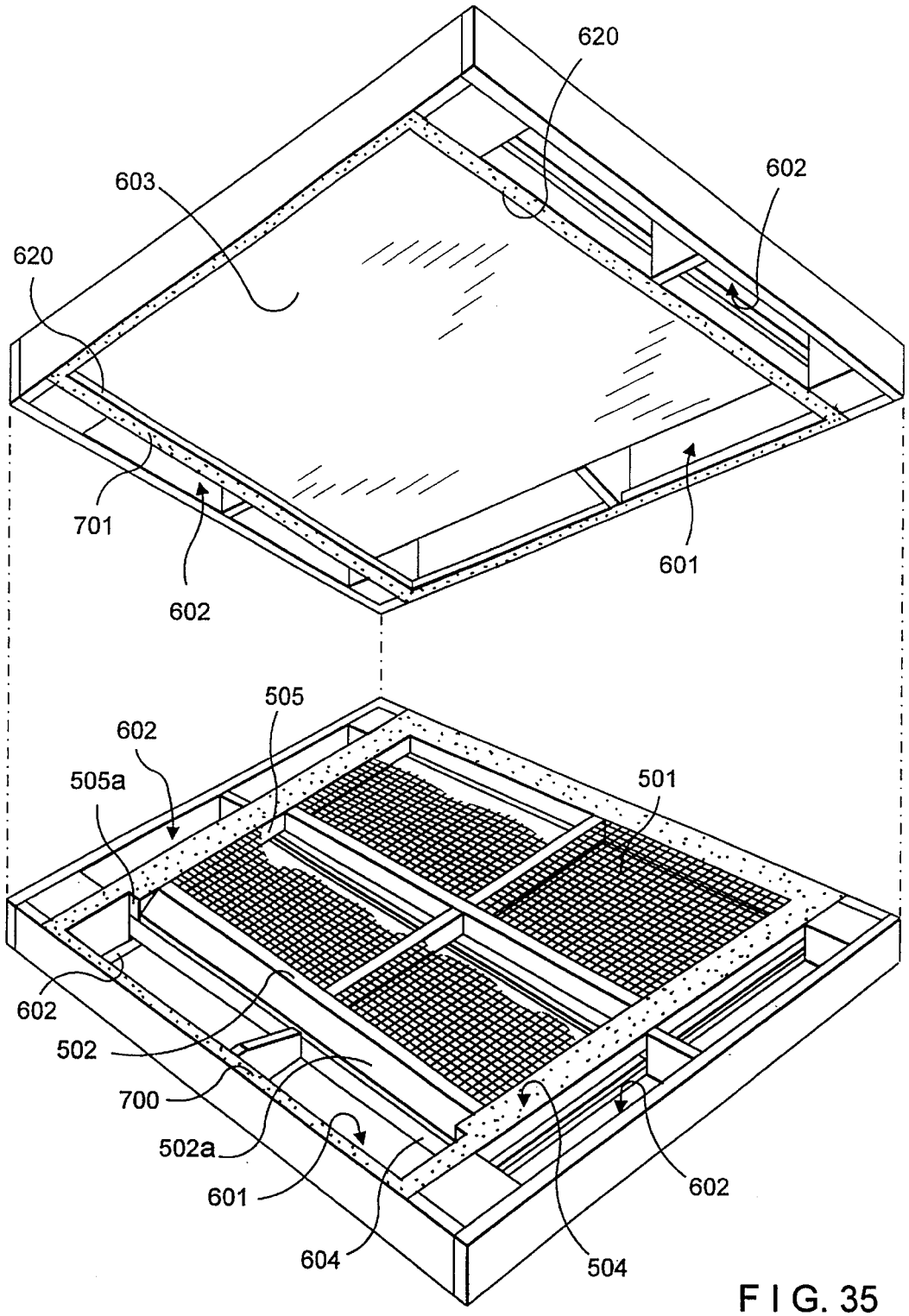
F I G. 35 PRIOR ART
FIG. 35 is a view explaining a relationship of engagement when the assembled sifter frames of the prior art are stacked in an upward/downward direction.
Figure 36:
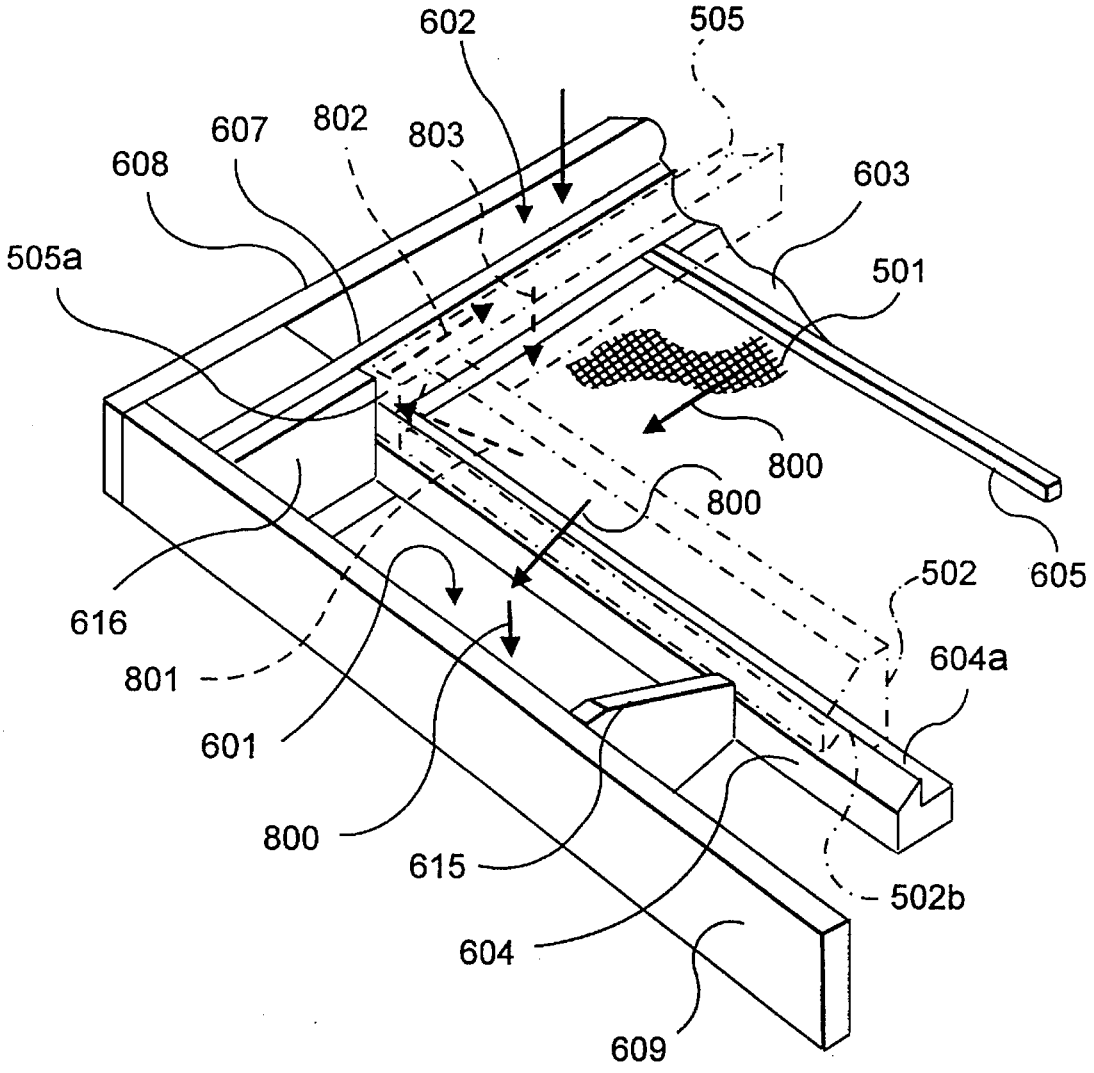
F I G. 36 PRIOR ART
FIG. 36 is a view perspectively showing the interior of the main portion of the sifter frame of the prior art to explain a mixed state of rough powder (powder particles to be treated) with fine powder.

For the above purpose, the upper surfaces and lower surfaces of the inner frame of the embodiment are made flush with each other, that is, this arrangement is made for the purpose that when sifter frames are stacked to multi-stages, surfaces to be sealed are formed on the same plane. That is, to explain with respect to the above embodiment, in order to seal the engaging surfaces denoted by numeral **458*a* around the rough powder dropping port 459, it is preferable to apply an intimate contact sheet 458*a* such as non-woven fabric, felt or the like to the lower surface of the four sides thereof (or to the upper surface of the four sides of the outer frame) (refer to FIG. 24). An inclined surface similar to that of the above embodiments may be formed to the partition wall 458 (refer to numeral 502*a* of FIG. 32) to enable rough powder to easily drop into the rough powder dropping port 458**.

Figure 23:
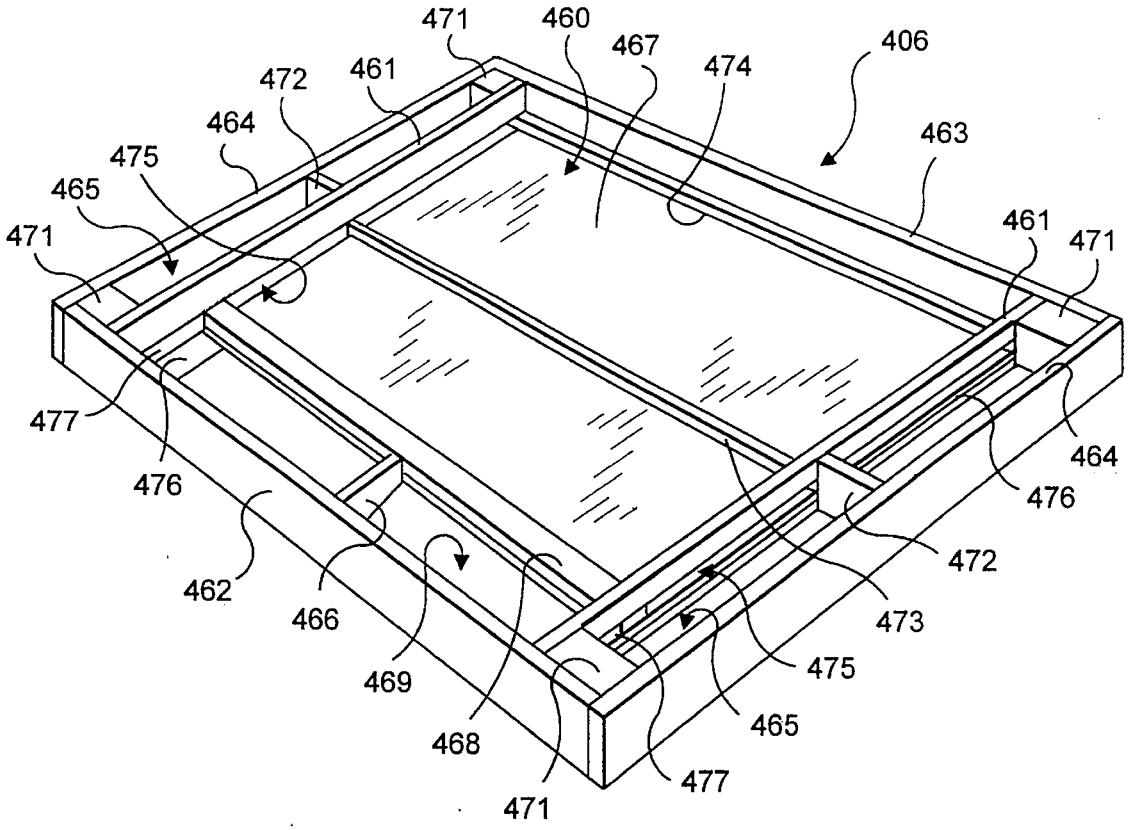
FIG. 23 is an outside perspective view of an outer frame constituting the sifter frame of the embodiment 6.

FIG. 23 shows the outer frame 406 of the embodiment. An inner frame fitting portion 460 formed to a recessed rectangular shape so that the inner frame 405 is inserted into and fitted with it is formed to a rectangular shape which is in coincidence with the outside shape of the inner frame 405 by a pair of inner side walls 461, 461 and a pair of outer side walls 462, 463 perpendicular to them. The inside of the outer frame 406 is partitioned to a fine powder receiving region provided with a receiving plate 467 and the rough powder dropping port 469 by a partition wall 468. The rough powder dropping port 469 and the partition wall 468 are arranged such that the position and shape thereof coincide with those of the rough powder dropping port 459 and the partition wall 458 of the inner frame 405.

A pair of outer side walls 464, 464 are disposed outwardly of a pair of the inner side walls 462, 462 in parallel therewith and fixed to the outer side walls 462, 463 and the inner side walls 461, 461 by blocks 471, 471, 471, 471 at four corners and reinforcing intermediate brackets 472, 472 to form a rectangular four-side frame as a whole as well as to form fine powder dropping ports 465, 465 each opened in an upward/downward direction between a pair of the inner side walls 461, 461 and a pair of the outer side walls 464, 464. Note, numeral 466 denotes a reinforcing intermediate bracket for fixing the partition wall 468 to the outer side wall 462.

The receiving plate 467 in the embodiment is composed of a rectangular stainless steel sheet fixed by screws to the lower surfaces of, for example, the partition wall 468 and inner frame receiving stands 473, 474 disposed between a pair of the inner side walls 461 of the lower surfaces thereof, the inner frame receiving stands 473, 474 being composed of two wood bars each having the same height as that of the partition wall 468. Further, lower inner side walls 476, 476 are disposed on the lower side of the receiving plate 467 so that they constitute a pair with the inner side walls 461, 461. The lower surfaces of the lower inner side walls 476, 476 are flush with the lower surfaces of the outer side walls 462–464. Note, the inner frame receiving stand 474 is disposed in contact with the outer side wall 463 and another inner frame receiving stand 473 is disposed at an intermediate position between the partition wall 468 and the inner frame receiving stand 474. Since they are disposed as described above, the receiving plate 467 provides a space for the fine powder receiving region for receiving fine powder (through) having passed through the sifter net 451 of the inner frame 405 inserted into and fitted with the inner frame fitting portion. As the shifter frame is vibrated, the fine powder is dropped into the fine powder dropping ports 465 from slit-shaped fine powder dropping ports 475 each formed between the lower surface of the inner side wall 461 and the receiving plate 467. Note, numeral 477 denotes brackets fixed to close gaps between the inner side wall 461 and the lower inner side wall 476 at the both ends of the rough powder dropping port 469.

The upper surface of the partition wall 468 and the upper surfaces of the inner frame receiving stands 473, 474 in the inner frame fitting portion are located at such a position of depth that when the inner frame 405 is placed on the above surfaces by being inserted into and fitted with the inner frame fitting portion, the upper surfaces of the inner side wall 461 and the outer side walls 462–464 are flush with the upper surface of the inner frame 405.

Note, as described with reference to FIG. 26, the lower inner side wall 476 has a thickness for enabling the lower surface 476*a* thereof to be extended to the upper surfaces of the inner side wall 461 and the frame member 454 (or 455) of the inner frame of a sifter frame stacked to the lower stage. With this provision, when sifter frames are stacked, an intimate contact force can be applied to the inner frame 405 in an upward/downward direction and further a gap between the inner side wall 461 and the frame member 454 (or 455) through which rough powder may enter the fine powder region can be securely sealed by the lower inner side wall 476 extending thereto. Further, it is preferable that the lower portions of the outer side walls 462, 463 are made thicker than the upper portions thereof by being provided with a taper or being stepped, the outer side wall 462 is composed of a frame member which is thicker than the outer side wall 463, and an additional depressing bracket is used so that the frame members 452, 453 of the inner frame 405 of a sifter frame stacked to the lower stage are depressed by the outer side walls 462, 463 of the outer frame 406 of the upper stage.

Figure 25:
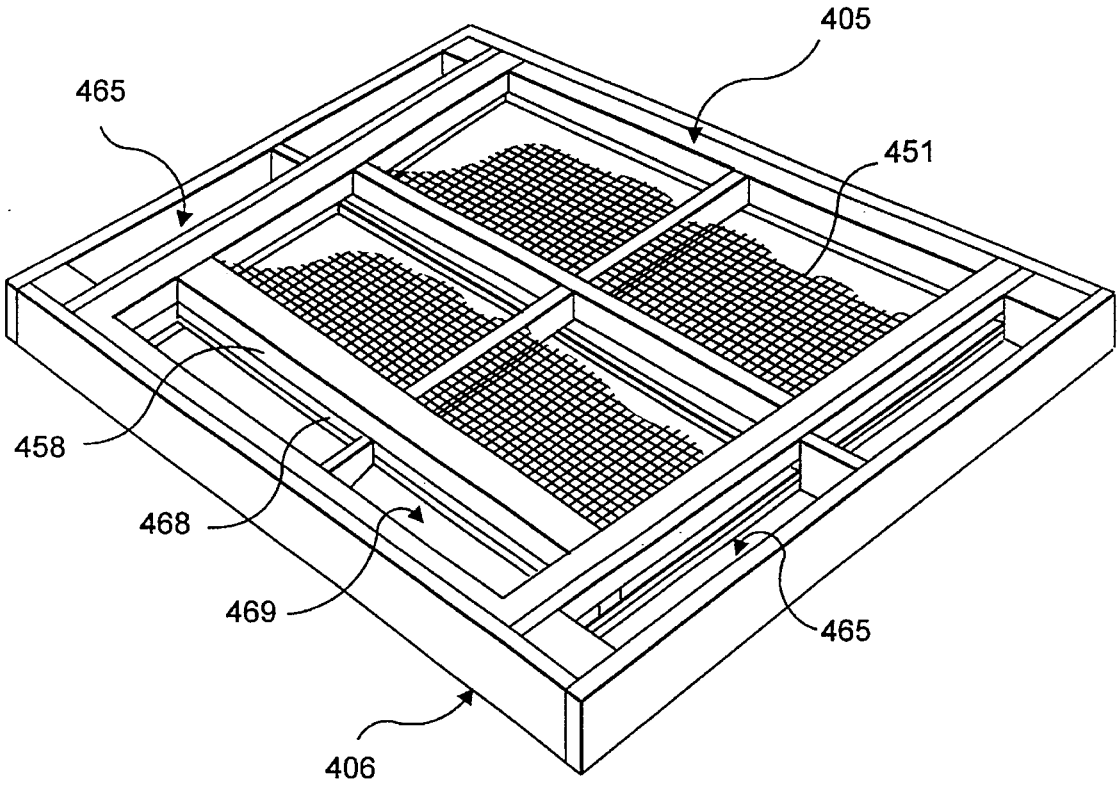
FIG. 25 is an outside perspective view showing a state that the inner frame and the outer frame shown in the unfolded view of FIG. 24 are fitted with each other for assembly.

FIG. 24 shows a state that the inner frame 405 arranged as described above is inserted into and fitted with the inner frame fitting portion 460 of the outer frame 406 arranged as described above. That is, the inner frame 405 is inserted into and placed on the partition wall 468 and the inner frame receiving stands 473, 474 in the inner frame fitting portion 460 formed by the receiving plate 467, the inner side walls 461, 461, the outer side walls 462, 463 and the like of the outer frame 406. FIG. 25 shows a state of the inside frame 5 assembled with the outer frame 6.

In this way, as shown in FIG. 25, a sifter frame is assembled such that the region of the rough powder dropping port 469 is partitioned from the fine powder region formed as the space between the sifter net 451 and the receiving plate 467 by the partition walls 458, 468 of the inner frame and the outer frame and the other three sides, and the fine powder dropping ports 465, 465 on the both sides are caused to communicate with the rough powder region through the slit-shaped fine powder dropping ports 475 but partitioned from the rough powder dropping port 469 by the inner side wall 461, the lower inner side wall 476 and the brackets 477.

Figure 26:
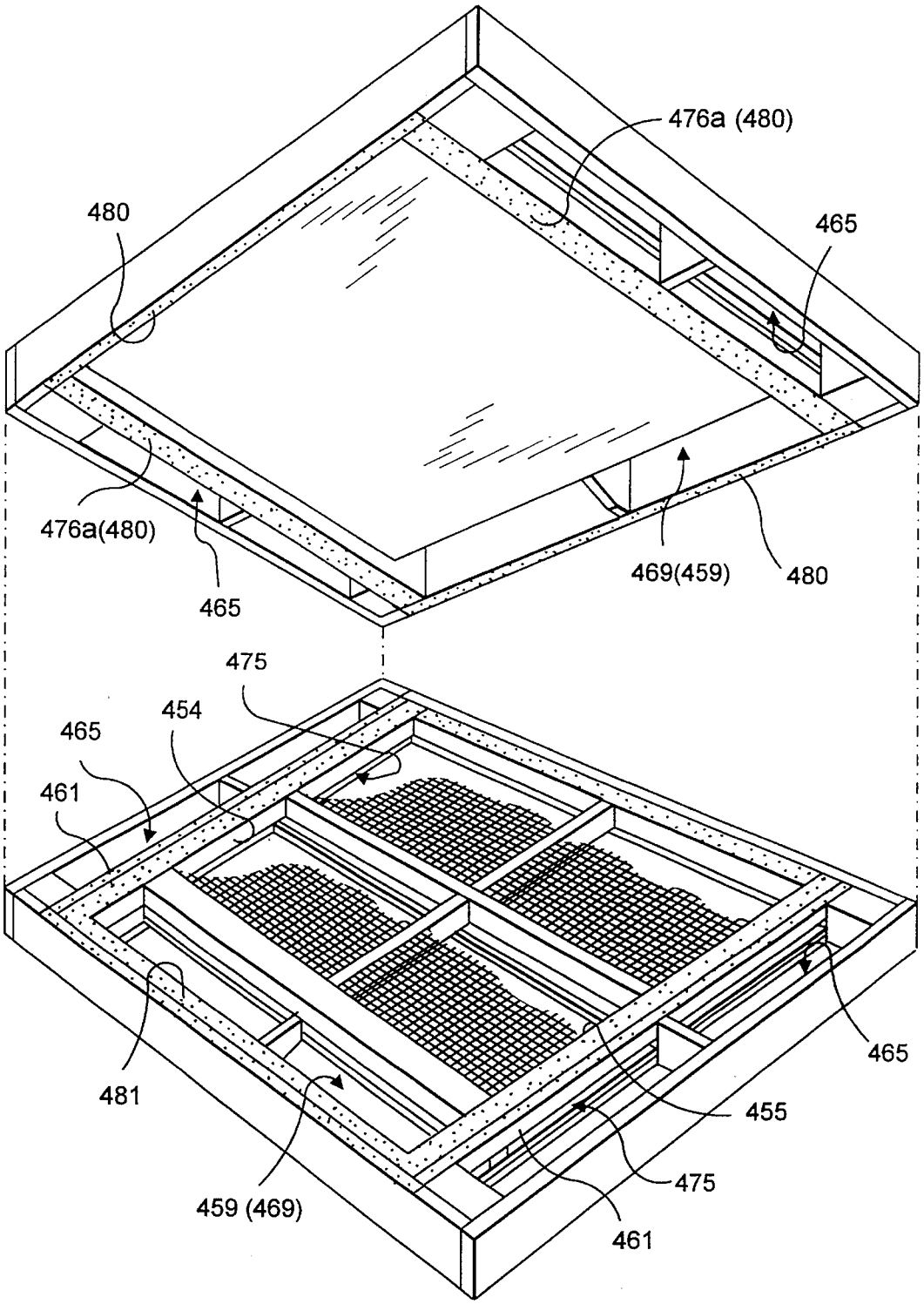
FIG. 26 is an unfolded view explaining a relationship of engagement when sifter frames of FIG. 25 each obtained by fitting the inner frame of the embodiment 6 with the outer frame thereof are stacked in an upward/downward direction.

Then, as shown in FIG. 26, a plurality of the sifter frames each assembled as described above are stacked with the rough powder dropping ports 469 thereof successively disposed alternately to arrange a group of the sifter frames. An annular seal surface 480 (shown by phantom lines in the figure) formed by applying the intimate contact sheet 458*a* on the lower surface of the sifter frame of the upper stage in FIG. 26 comes into contact with the a closed annular seal surface 481 formed on the upper surface of the sifter frame of the lower stage (shown by phantom lines in the figure), so that these seal surfaces are caused to firmly come into contact with each other by a storing pressure from the upper and lower side of the group of the sifter frames. With this arrangement, the rough powder dropping ports 469 of the rough powder regions, which are partitioned from the other spaces by a plurality of the stacked sifter frames and directed in an upward/downward direction, are located at the alternate positions of the respective stages as well as the space formed below the sifter net 451 and the receiving plate 467 of the upper stage sifter frame is partitioned and sealed from the fine powder dropping ports 465, 465 by the lower inner side walls 476, 476, whereby the continuous rough powder region which meanders horizontally from the upper side toward the lower side as a whole is formed. On the other hand, the fine powder dropping ports 465, 465 are formed as a port which is continued in an upward/downward direction by the stacked sifter frames and communicates with the space below the sifter net of the sifter frame of each stage through the slit-shaped fine powder dropping ports 475 as described above.

When a group of the sifter frames each arranged as described above are stacked to multi-stages and rough powder is supplied onto the sifter net of the uppermost sifter frame while the sifter frames are caused to make a circular motion, the rough powder drops onto the sifter net 451 of the next stage from the rough powder dropping port 469 while moving on the sifter net 451, then moves on the sifter net 451 of the next stage to the rough powder dropping port 469 located on the opposite side in the same way and further drops onto the sifter net of the next stage. Then, the rough powder is discharged to the outside of the system through the lowermost sifter frame while meandering with the successive repetition of the above operation (refer to FIG. 17). On the other hand, fine powder having passed through the sifter nets 451 of the respective stages drops onto a receiving plate 467, then drops into the fine powder dropping ports 465, 465 from right and left slit-shaped fine powder dropping ports 475 and is introduced to a fine powder collection path.

According to the sifter using the sifter frames arranged as described above, since the seal surfaces for partitioning and sealing the rough powder region from the fine powder region are formed as the annular seal surfaces located on the same plane, portions on which a pressure applying force does not act, which is found in prior art, do not exist anywhere, so that an intimate contact seal can be securely realized and a possibility of the mixture of rough powder with fine powder in the fine powder region can be securely prevented. When a test for sifting and separating flour was effected using the sifter having the arrangement of the embodiment 6 described with reference to FIG. 22–FIG. 26, it has been confirmed that the mixture of rough particles with fine powder can be completely prevented.

Embodiment 7

The embodiment 7 shown in FIG. 27–FIG. 31 is arranged substantially similarly to the embodiment 6 except that the embodiment 7 is an example an upper and lower frame type sifter frame for connecting a pair of an upper frame and a lower frame each having substantially the same plane, with the upper half portion of the fine powder dropping port of the embodiment 6 being accommodated in the inner frame.

Figure 27:
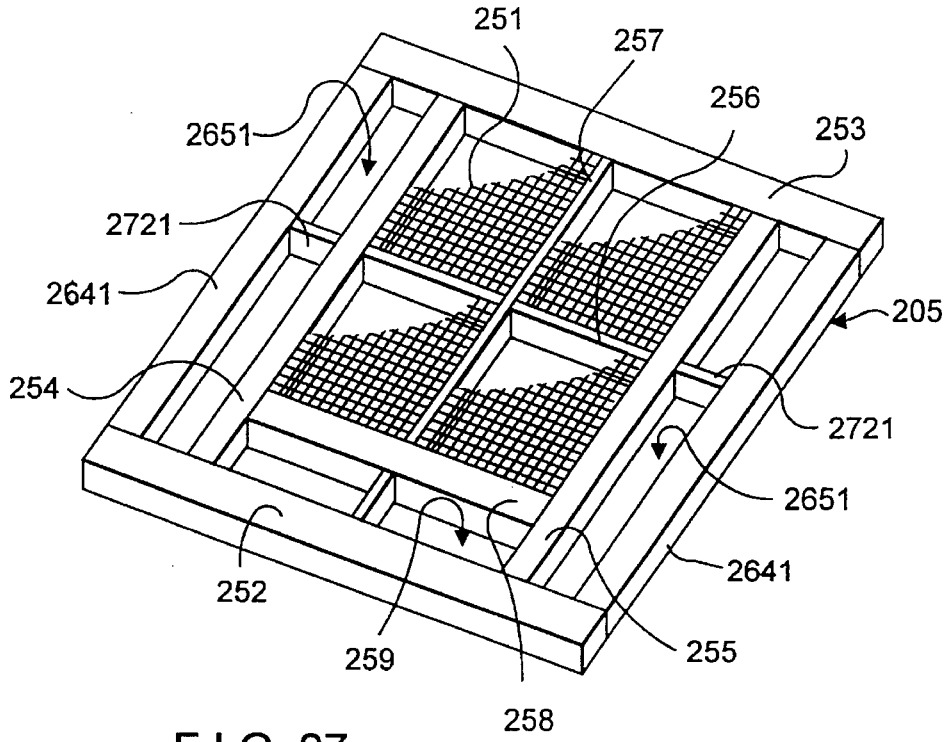
FIG. 27 is an outside perspective view of an inner frame constituting a sifter frame of an embodiment 7 of the present invention.

In FIG. 27–FIG. 31, an upper frame 205 in FIG. 27 is composed of frame members 252–255 of, for example, wood square columns constituting a rectangular four-side frame, a partition wall 258 for partitioning the inside of the rectangular four sides to a sifter net region 250 and the region of a rough powder dropping port 259, reinforcing wood bars 256, 257 disposed in the sifter net region 250 to a cross shape, a sifter net 251 stretched over the ceiling surface of the sifter net portion 250, and outer frame members 2641, 2641 disposed to the outside of the frame members 254–255. The outer frame members 2641, 2641 of them are spaced apart from the inner frame members 254, 255 to form fine powder dropping ports 2651, 2651. Numerals 2721, 2721 denote reinforcing intermediate brackets. Further, a crimp net is stretched below the sifter net 251 and a cleaner is interposed therebetween similarly to the embodiment 1.

Figure 29:
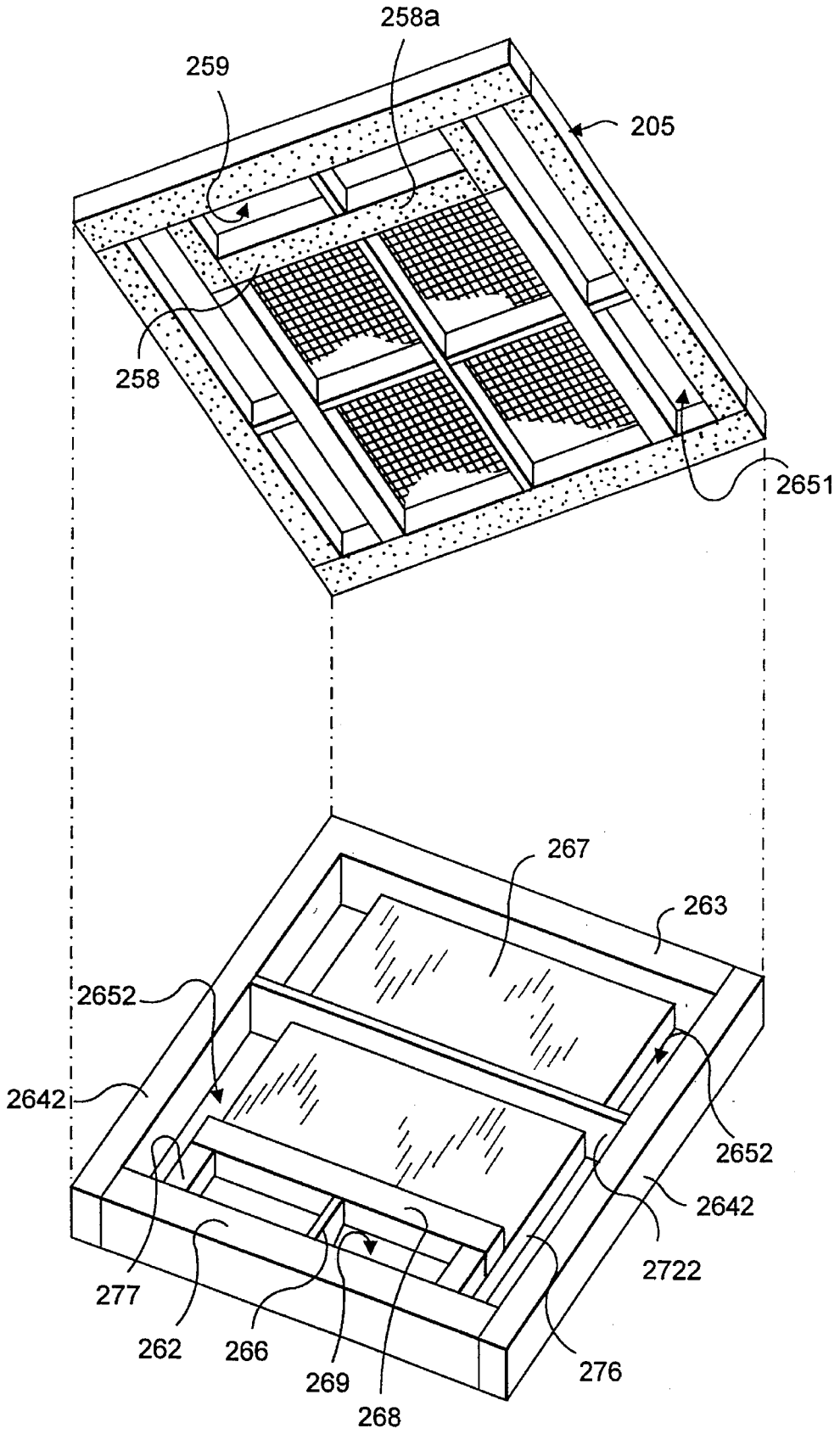
FIG. 29 is an unfolded view explaining a state that the inner frame of the embodiment 7 is fitted with the outer frame thereof.
Figure 30:
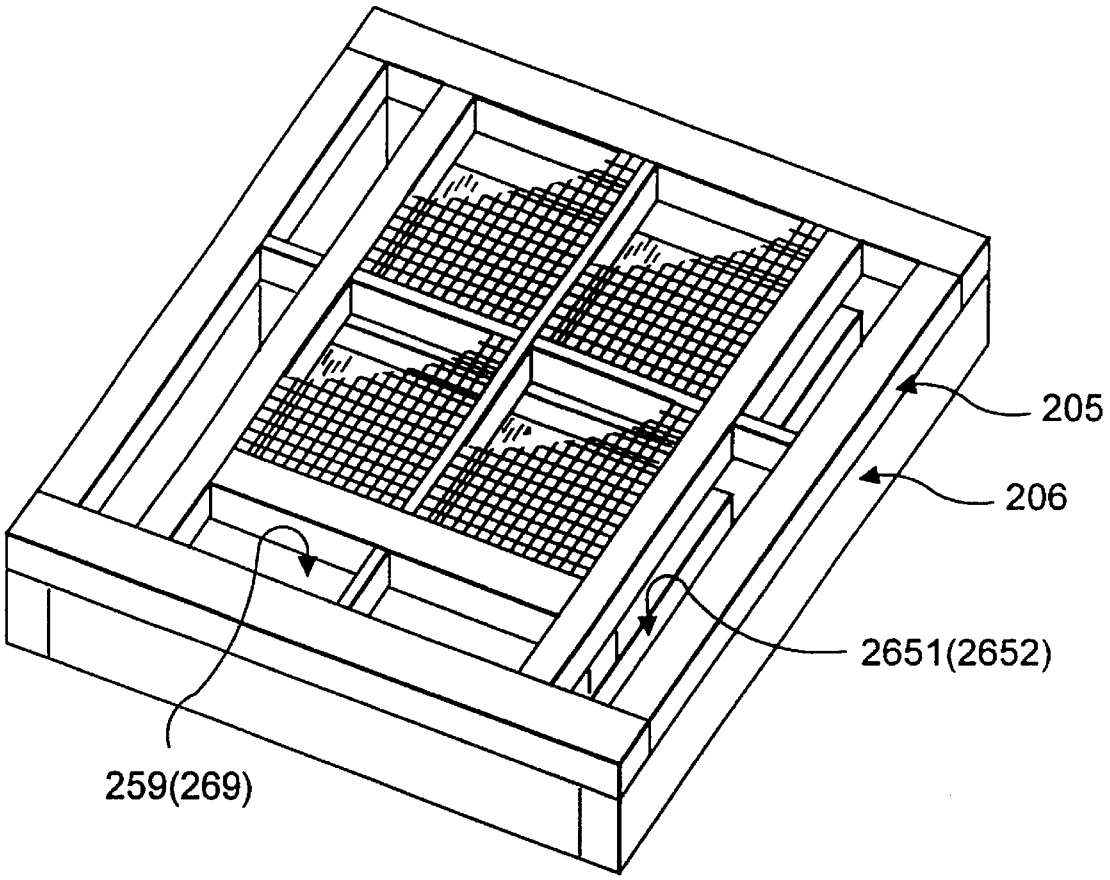
FIG. 30 is an outside perspective view showing a state that the inner frame and the outer frame shown in the unfolded view of FIG. 29 are fitted with each other for assembly.

As apparent from FIG. 27 and FIG. 29, the upper frame 205 of the embodiment has a feature that the frame members 252–255, 256, 257, 2641 and the like and the partition wall 258 are composed of square column members each having the same height with the upper surfaces thereof flush with the lower surfaces thereof and that the partition wall 258 partitioning the sifter net region 250 from the region of the rough powder dropping port 259 is composed of a frame member having a large cross sectional area so that it has a large modulus of section. A reason why such an arrangement is employed is to secure seal surfaces similar to the embodiment 1 and to prevent the formation of a gap between the partition wall 258 and the partition wall 268 of a lower frame to be described below. Note, to seal the engaging surfaces of the partition walls 258, 268 and the like, it is also preferable to apply an intimate contact sheet 258*a* such as non-woven fabric, felt and the like (refer to FIG. 29) to the lower surface of the partition wall 258 (or to the upper surface of the partition wall 268 of the outer frame). An inclined surface may be formed to the partition wall 258 (refer to numeral 502*a* of FIG. 32) in the same way as prior art to enable rough powder to easily drop into the rough powder dropping port 258.

Figure 28:
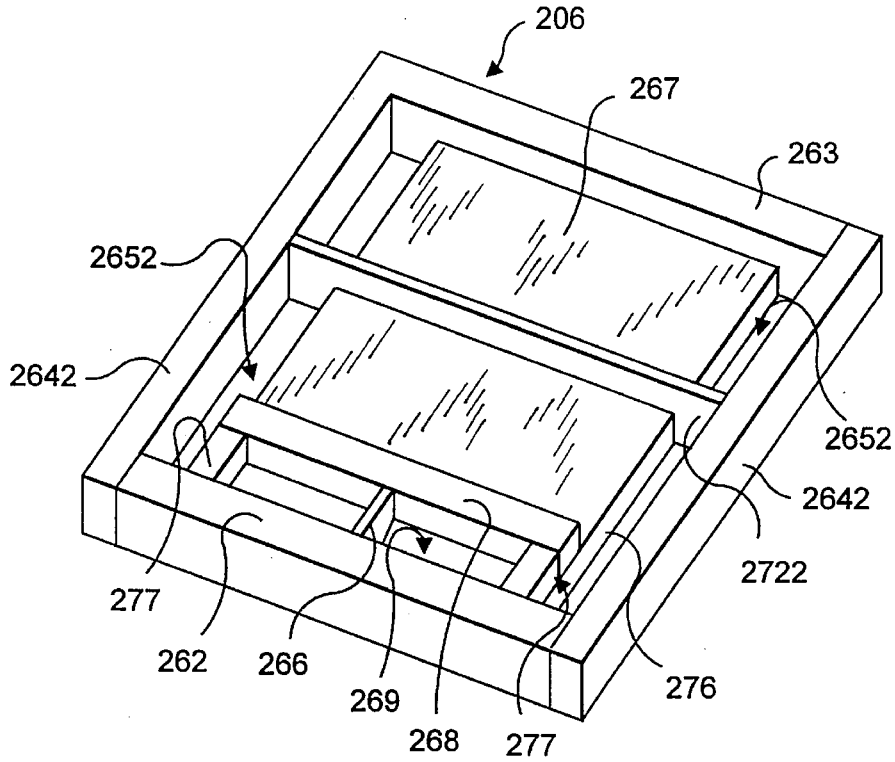
FIG. 28 is an outside perspective view of an outer frame constituting the sifter frame of the embodiment 7.

FIG. 28 shows the lower frame 206 of the embodiment which is partitioned to a fine powder receiving region provided with a receiving plate 267 and a rough powder dropping port 269 by outer side walls 2642, 2642, a pair of outer side walls 262, 263 perpendicular to them and the partitioning wall 268 inwardly of the outer side walls 262, 263, with the inner side walls of the lower frame 206 omitted. The rough powder dropping port 269 and the partition wall 268 are arranged such that the positions and shapes thereof coincide with those of the rough powder dropping port 259 and the partition wall 258 of the upper frame 205. Further, a pair of the parallel side walls 262, 263 are fixed to the outer side walls 2642 to form a rectangular four-side frame having the same outside shape as that of the upper frame 205 as a whole as well as fine powder dropping ports 2652, 2652 each opened in an upward/downward direction is formed between each of a pair of the outer side walls 2642, 2642 and the receiving plate 267. Note, numeral 266 denotes a reinforcing intermediate bracket for fixing the partition wall 268 to the outer side wall 262.

The receiving plate 267 in the embodiment is formed from a rectangular stainless steel sheet fixed by screws. Further, lower inner side walls 276, 276 are disposed under the receiving plate 267 and constitute a vertical pair with the frame members 254, 254 of the upper frame. The lower surfaces of the lower inner side walls 276, 276 are flush with the lower surfaces of the outer side walls 262, 263, 2642 to press the upper frames 255, 254 stacked to the next stage. The receiving plate 267 provides the space of a fine powder region for receiving fine powder (through) having passed through the sifter net 251 of the upper frame 205. As the sifter frame is vibrated, the fine powder is dropped into the fine powder dropping ports 2652. Note, numeral 277 denotes brackets fixed to close the gaps between the inner side wall 261 and the lower inner side wall 276 at the both ends of the rough powder dropping port 269.

As described with reference to FIG. 11, when the sifter frames are stacked in multi-stages, the lower inner side walls 276 are disposed such that the seal surfaces 280 of intimate contact sheets 276*a* applied to the lower surfaces thereof are engaged with the frame member 254 (or 255) of the upper frame of the sifter frame stacked to the lower stage. With this provision, when the sifter frames are stacked, an intimate contact force is applied to thereby securely seal a gap through which rough powder may enter the fine powder region.

FIG. 29 shows a state that the upper frame 205 arranged as described above is vertically connected to the lower frame 206 arranged as described above, and further FIG. 30 shows the state of the vertical connection.

In the embodiment, although the frame members 254, 255 of the upper frame are supported only by the intermediate members 2721, the division of the rough powder region from the fine powder region as an object of the present invention can be sufficiently achieved by the sufficient intimate contact effected by the brackets 277 and the partition wall 268.

With this arrangement, a sifter frame is assembled such that the regions of the rough powder dropping ports 259, 269 are partitioned from the fine powder region formed as the space between the sifter net 251 and the receiving plate 267 by the partition walls 258, 268 of the upper frame and the lower frame, and the fine powder dropping ports 2651, 2652 on the both sides are partitioned from the rough powder dropping ports 259, 269 by the frame members 254, 255 of the upper frame, the lower inner side walls 276 and the bracket 277.

Figure 31:
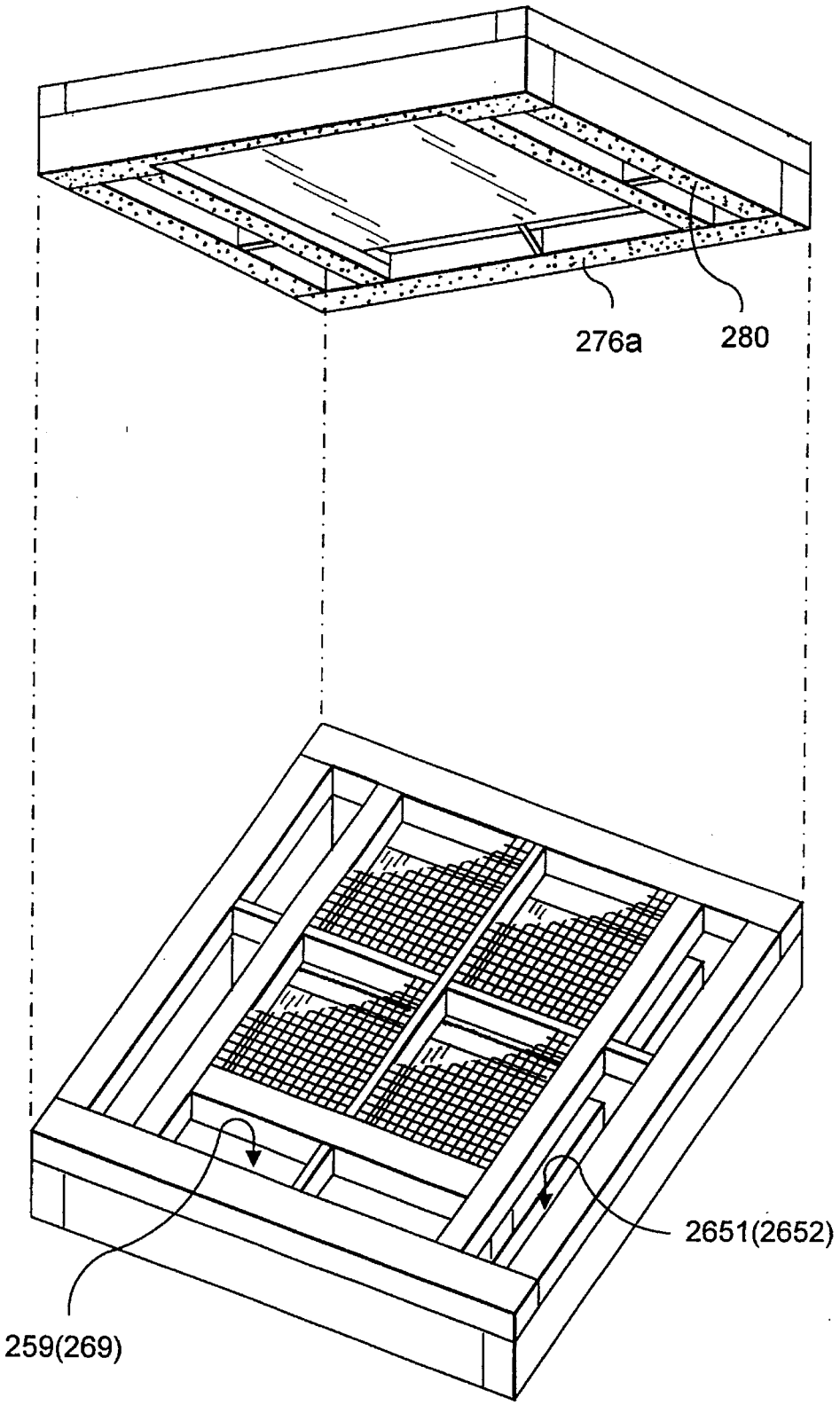
FIG. 31 is an unfolded view explaining a relationship of engagement when sifter frames of FIG. 30 each obtained by fitting the inner frame of the embodiment 7 with the outer frame thereof are stacked in an upward/downward direction.

Then, as shown in FIG. 31, a plurality of the sifter frames assembled as described above are stacked with the rough powder dropping ports 259, 269 successively disposed alternately to constitute a group of the sifter frames as well as the seal surfaces 280 formed by applying an intimate contact sheet on the lower surface of the sifter frame stacked to the upper stage in FIG. 31 (the seal surface 258*a* of the partition wall shown by phantom lines in the figure) and the like come into contact with the seal surfaces formed on the upper surface of the sifter frame stacked to the lower surface, whereby these seal surfaces are pressed and sealed by a strong force applied from the upper and lower sides of a group of the sifter frames. With this arrangement, the rough powder dropping ports 259, 269 of the rough powder region which are partitioned by a plurality of the stacked sifter frames from the other spaces and directed in an upward/downward direction are located at alternate positions of the respective stages as well as the space formed below the sifter net 251 and the receiving plate 267 of the upper stage sifter frame is partitioned from the fine powder dropping ports 2651, 2652 by the lower inner side walls 276, 276, whereby the continuous rough powder region which meanders horizontally from the upper side toward the lower side is formed as a whole. On the other hand, the fine powder dropping ports 2651, 2652 are formed as a port which is continued by the stacked sifter frames in an upward/downward direction and communicates with the space below the sifter net 251 through the gap between each of the frame members 254, 255 of the aforesaid upper frame and the receiving plate 267 with respect to the sifter frame of each stage. With this arrangement, the paths of the fine powder can be widened to cope with fine powder difficult to flow.

When a group of the sifter frames each arranged as described above are stacked in multi-stages and rough powder is supplied onto the sifter net of the uppermost sifter frame while the sifter frames are caused to make a circular motion, the rough powder drops onto the sifter net 251 of the next stage from the rough powder dropping ports 259, 269 while moving on the sifter net 251 in the same way as the embodiment 1, then moves on the sifter net 251 of the next stage to the rough powder dropping ports 259, 269 located on the opposite side in the same way and further drops onto the sifter net of the next stage. Then, the rough powder is discharged to the outside of the system through the lowermost sifter frame while meandering with the successive repetition of the above operation (refer to FIG. 17). On the other hand, fine powder having passed through the sifter nets 251 of the respective stages drops onto the receiving plate 267, then drops into the fine powder dropping ports 2651, 2652 from right and left slit-shaped fine powder dropping ports and is introduced to a fine powder collection path.

According to the sifter using the sifter frames arranged as described above, since the seal surfaces for partitioning and sealing the rough powder region from the fine powder region are formed as annular surfaces located on the same plane, portions on which a pressure applying force does not act, which is found the prior art, do not exist anywhere, so that an intimate contact seal can be securely realized and a possibility of the mixture of rough powder with fine powder in the fine powder region can be securely prevented.

When a test for sifting and separating flour was effected using the sifter having the arrangement of the embodiment 7 described with reference to FIG. 27–FIG. 31, it was confirmed that the mixture of rough particles with fine powder can be completely prevented.

As described above, according to the sifter frame having the first to fourth characteristic arrangements of the present invention, since the portion in which the sifter net is stretched can be prepared as a limited arrangement in the same way as prior art, there can be obtained an effect that a volume of sifter frames to be prepared for replacement can be reduced and labor for a replacement job can be saved. Further, there can be obtained an effect that the mixture of rough powder with fine powder which may be caused by the conventional shifter frame can be substantially completely prevented.

Furthermore, there can be obtained an effect that a highly valuable product can be obtained without the mixture of rough powder and the like.

What is claimed is:

1. A sifter frame for a powder particle sifter comprising:

a pair of frame elements including an outer frame and an inner frame, the outer frame having an outer block formed to a rectangular four-sided shape by outer block frame members each having the same height and including in the inner side of the outer block each of a pair of fine powder dropping ports opened in an upward/downward direction along both inner sides of a pair of the confronting sides of the rectangular four sides, a rough powder dropping port opened in an upward/downward direction along the inner side of one of the other pair of the confronting sides, outer block frame members constituting the sides opposite to the other pair of the confronting sides, and a rectangular fine powder receiving plate horizontally disposed at a position of intermediate height in the region surrounded by the rough powder dropping port and the fine powder dropping ports wherein the space on the receiving plate enables fine powder on the receiving plate to be dropped into the fine powder dropping ports but being partitioned from the rough powder dropping port by a partition wall; and the inner frame being formed to a substantially rectangular four-sided shape by outer block frame members each having the same height and fitted with the space on the receiving plate of the outer frame without producing any gap therebetween so that the upper surface of said inner frame is flush with said outer frame wherein fine powder is sifted from the rough powder in powder particles moving on a rectangular sifter net stretched over the ceiling surface of said outer block frame members through said sifter net and dropped onto the receiving plate;

said inner frame being provided with a pair of the outer block frame members in contact with the fine powder dropping ports of said outer frame, the outer block frame member projecting more to said rough powder dropping port than the outer block frame members of said inner frame in contact with the rough powder dropping port of said outer frame, as well as said outer frame being provided with a receiving portion on which the projected portions of a pair of the outer block frame members of said inner frame are to be placed and arc-shaped or inclined seal surfaces are formed to the surfaces wherein said projected portions are engaged with said receiving portion.

2. A sifter frame for a powder particle sifter according to claim 1, wherein an air tight seal sheet is applied to any one of said arc-shaped or inclined engaging surfaces where the projected portions of the outer block frame members of said inner frame are engaged with said receiving portion formed to said outer frame on which said projected portions are to be placed.

3. A sifter frame for a powder particle sifter according to claim 1, wherein the side surface of said inner frame where said outer block frame members in contact with said rough powder dropping port faces to said rough powder dropping port is formed to be flush with the side surface of said outer frame where said partition wall partitioning the space on the receiving plate of said outer frame from said rough powder dropping port faces to said rough powder dropping port, as well as a shield sheet member for covering up to the side surface of said outer frame is formed to the side surface of said inner frame.

4. A sifter frame for a powder particle shifter according to claim 2, wherein the side surface of said inner frame where said outer block frame members in contact with said rough powder dropping port faces to said rough powder dropping port is formed to be flush with the side surface of said outer frame where said partition wall partitioning the space on the receiving plate of said outer frame from said rough powder dropping port faces to said rough powder dropping port, as well as a shield sheet member for covering up to the side surface of said outer frame is formed to the side surface of said inner frame.

* * * * *